US010224588B2

(12) United States Patent
Weiβ

(10) Patent No.: US 10,224,588 B2
(45) Date of Patent: Mar. 5, 2019

(54) MULTIPLEX FILTER WITH DIELECTRIC SUBSTRATE FOR THE TRANSMISSION OF TM MODES IN THE TRANSVERSE DIRECTION

(71) Applicant: Kathrein-Werke KG, Rosenheim (DE)

(72) Inventor: Frank Weiβ, Grβbkarolinenfeld (DE)

(73) Assignee: Kathrein SE, Rosenheim (DE)

( * ) Notice: Subject to any disclaimer, the term of this patent is extended or adjusted under 35 U.S.C. 154(b) by 180 days.

(21) Appl. No.: 15/142,337

(22) Filed: Apr. 29, 2016

(65) Prior Publication Data

US 2016/0322687 A1 Nov. 3, 2016

(30) Foreign Application Priority Data

Apr. 30, 2015 (DE) ..... 10 2015 005 613

(51) Int. Cl.
*H01P 1/208* (2006.01)
*H01P 1/213* (2006.01)
*H01P 5/12* (2006.01)

(52) U.S. Cl.
CPC ..... *H01P 1/2084* (2013.01); *H01P 1/2133* (2013.01); *H01P 1/2138* (2013.01); *H01P 5/12* (2013.01)

(58) Field of Classification Search
CPC ..... H01P 1/213; H01P 1/2133; H01P 1/2138; H01P 5/12; H01P 1/2084
USPC ..... 333/135, 137, 208, 209, 212
See application file for complete search history.

(56) References Cited

U.S. PATENT DOCUMENTS 4,267,537 A 5/1981 Karmel
4,721,933 A * 1/1988 Schwartz ..... H01P 1/2082 333/209
4,881,051 A 11/1989 Tang et al.
5,576,674 A 11/1996 Jachowski
5,764,115 A 6/1998 Hattori et al.
6,072,378 A 6/2000 Kurisu et al.
(Continued)

FOREIGN PATENT DOCUMENTS

DE 198 47 006 A1 4/2000
WO 2014/128484 A1 8/2014

OTHER PUBLICATIONS

Ishikawa, Youhei, et al., "1.9 GHz Compact Love Loss Dielectric Duplexer Designed by Dual Mode Waveguide Transmission Line Method", Sep. 5, 1994, pp. 1179-1184, XP 000678211.
(Continued)

*Primary Examiner* — Rakesh Patel
(74) *Attorney, Agent, or Firm* — Nixon & Vanderhye P.C.

(57) ABSTRACT

A multiplex filter has at least n filter chambers which are surrounded by a housing and/or at least one insert positioned in the housing. A metal dividing device is constructed in each of the n filter chambers, dividing each filter chamber into m resonator chambers, wherein m≥2. The resonator chambers are coupled perpendicular to the H fields and/or parallel to the central axis or with a component essentially perpendicular to the H fields and/or parallel to the central axis. A common connection is guided into the first filter chamber via a first opening in the housing, and is coupled in the same to the m resonators of the m resonator chambers. As a result of the fact that the coupling is established perpendicular to the H field, the resonator can have a very compact construction.

28 Claims, 12 Drawing Sheets

(56) References Cited

U.S. PATENT DOCUMENTS

| | | | | |
|---|---|---|---|---|
| 6,549,092 | B1 | 4/2003 | Hattori et al. | |
| 6,714,096 | B1 | 3/2004 | Broad et al. | |
| 2002/0041221 | A1 | 4/2002 | Abdulnour | |
| 2003/0011444 | A1 | 1/2003 | Wang | |
| 2014/0091878 | A1* | 4/2014 | Bila | H03H 7/46 333/134 |

OTHER PUBLICATIONS

Kobayoshi, Yoshio, et al., "Bandpass Filters Using Electrically-Coupled TM010 Dielectric Rod Resonators", Electronics & Communications in Japan, 1983, vol. 66-B, No. 3, pp. 33-42, XP-001402070.

Höft et al., "Compact Base-Station Filters Using TM-Mode Dielectric Resonators", Jan. 2006, 4 pages.

Chen, Ming Hui, "Short-Circuit Tuning Method for Singly Terminated Filters," IEEE Transactions on Microwave Theory and Techniques, vol. MTT-25, No. 12, Dec. 1977, pp. 1032-1036, XP55335299A.

Dishal, Milton, "Alignment and Adjustment of Synchronously Tuned Multiple-Resonant-Circuit Filters," Proceedings of the I.R.E, Nov. 1951, pp. 1448-1455, XP11153349A.

Ness, John B., "A Unified Approach to the Design, Measurement, and Tuninng of Coupled-Resonator Filters," IEEE Transactions on Microwave Theory and Techniques, vol. 46, No. 4, Apr. 1998, pp. 343-351, XP11037127A.

Pepe, Giuseppe, et al., "Sequential Tuning of Microwave Filters Using Adaptive Models and Parameter Extraction," IEEE Transactions on Microwave Theory and Techniques, vol. 53, No. 1, Jan. 2005, pp. 22-31, XP11125348A.

* cited by examiner

MULTIPLEX FILTER WITH DIELECTRIC SUBSTRATE FOR THE TRANSMISSION OF TM MODES IN THE TRANSVERSE DIRECTION

CROSS-REFERENCE TO RELATED APPLICATIONS

This application claims priority from German Patent Application No. 10 2015 005 613.1 filed Apr. 30, 2015, incorporated herein by reference.

STATEMENT REGARDING FEDERALLY SPONSORED RESEARCH OR DEVELOPMENT

None.

FIELD

The technology herein relates to a multiplex filter which is particularly suitable for the transmission of TM modes in the transverse direction.

BACKGROUND

In the context of the transmission of TM modes and/or TM waves, only the electrical field has a component in the direction of propagation, and the magnetic fields are entirely perpendicular to the direction of propagation. TM waves are therefore also called E waves. A multiplex filter in this context comprises a common connection and at least two signal line connections, wherein the at least two signal line connections are each connected to the common connection via one signal transmission path. The direction of signal transmission can be from the common connection to one of the multiple signal line connections (for example in the form of a diplexer or multiplexer), and also simultaneously from another one of the signal line connections to the common connection (for example in the form of a duplexer which has two further connections in addition to the first common connection). Each signal transmission path passes through different resonator chambers such that different frequency ranges are filtered in the same.

The publication by M. Höft and T. Magath, "Compact Base-Station Filters Using TM-Mode Dielectric Resonators," describes the construction of a high-frequency filter which has multiple dielectric resonators. In this case, the individual resonators are coupled parallel to the direction of propagation of the H field.

A disadvantage of this construction is that more space is required to implement the desired filter properties. This space requirement increases in proportion to the number of signal transmission paths which should be included.

Therefore, the problem addressed herein is that of creating a multiplex filter which is particularly suitable for the transmission of TM modes in the transverse direction, wherein this multiplex filter should be constructed in both a space-saving and cost-effective manner.

This problem is addressed with respect to a multiplex filter and a method for tuning such a multiplex filter. Advantageous non-limiting implementations of the multiplex filter or of the method for tuning the multiplex filter are provided.

The multiplex filter has a housing which has a housing base, a housing cover spaced apart from the housing base, and a circumferential housing wall between the housing base and the housing cover. The housing base and the housing cover are preferably intersected by a central axis. The multiplex filter also has at least n filter chambers which are surrounded by the housing and/or at least one insert positioned in the housing.

A dividing device which consists of metal or which comprises metal is constructed in each of the n filter chambers, dividing each filter chamber into m resonator chambers, wherein m≥2, and wherein each of the same form one resonator. The dividing devices are arranged parallel to the central axis or with a component substantially parallel to the central axis and divide the filter chamber into m resonator chambers parallel to the central axis or with a component substantially parallel to the central axis. The resonator chambers in each filter chamber, and therefore each of the resonators, are decoupled from each other by the dividing devices situated in each filter chamber. In addition, at least n dielectrics are included, of which at least one is arranged in each filter chamber. The multiplex filter has n−1 separators. The n filter chambers are arranged along a central axis which is perpendicular to the H field, or with a component essentially perpendicular to the H field, wherein every two filter chambers which are adjacent or are adjacent along the central axis are separated by one separator. Each of the n−1 separators has at least m coupling openings via which every two resonator chambers which are adjacent in the signal transmission direction are coupled to each other. The resonator chambers are coupled perpendicular to the H fields and/or parallel to the central axis or with a component essentially perpendicular to the H fields and/or parallel to the central axis. A common connection is guided into the first filter chamber via a first opening in the housing, and is coupled in the same to the m resonators of the m resonator chambers. As a result of the fact that the coupling is established perpendicular to the H field, the resonator can have a very compact construction. In addition, m signal line connections are coupled via m openings in the housing to the m resonators in the m resonator chambers in the nth filter chamber.

It is particularly advantageous in this case that the individual filter chambers, and accordingly the individual resonator chambers with the resonators are stacked one above the other, wherein the same are coupled by coupling openings which are constructed inside the separators. The coupling is in the signal transmission direction, and therefore perpendicular to the H field. This enables a very compact construction of the resonator because multiple signal transmission directions are established parallel to the central axis and are uncoupled from each other.

The method for tuning the multiplex filter comprises various method steps. In one method step, at the beginning, all coupling openings of the 1+Xth separator and/or the n−1−Xth separator are closed, wherein X is equal to 0 at the beginning. In a further method step, a reflection parameter is measured at the common connection and/or at least one, and preferably all, signal line connections. Subsequently, the resonance frequency and/or the coupling bandwidth, and/or the input coupling bandwidth, is/are adjusted to a desired value. This method can be used to adjust the resonance frequency and/or the coupling bandwidth of m resonator chambers of a filter chamber to the desired value independently of further resonator chambers in other filter chambers.

There is a further advantage when one or both end faces of each of the n dielectrics are coated with a metal layer, wherein this metal layer then constitutes one of the n−1 separators, and wherein at least one recess inside the metal layer forms the at least one coupling opening. The use of accordingly coated dielectrics enables a further reduction of the size of the high-frequency filter.

There is also a further advantage for the multiplex filter if a diameter of at least one, and preferably all, filter chambers is defined and/or prespecified by at least one insert in each case, and particularly by an annular insert which leans against the housing wall. The resonance frequency can be tuned in this way. The configuration of the insert leaning against the housing wall in a form-fitting manner also ensures that the insert cannot slide from its position over time.

The insert of one, and preferably of each, filter chamber has wall segments adjacent to the inner wall of the housing with different thicknesses, such that it is possible to adjust the volumes of individual resonator chambers of a filter chamber independently of each other, and/or for said volumes to differ from each other. The use of such inserts further increases the flexibility of the multiplex filter.

A further advantage of the multiplex filter arises when the inserts of at least two of the n filter chambers which do not directly follow each other—that is, are not adjacent to each other—have an opening, and the at least two openings are connected to each other by a channel which runs, by way of example, at last partially inside the housing wall. An electrical line runs in this channel, and the electrical line couples the two resonator chambers of the different filter chambers to each other capacitively and/or inductively. In this way, despite the compact construction of the multiplex filter, it is possible to achieve an overcoupling of resonators which are not directly adjacent.

An advantage also arises when at least one anti-turning element is attached between at least one of the n−1 separators and the at least one insert and/or the adjacent dielectric, to prevent these elements from turning with respect to each other. In this case, it is possible for at least one anti-turning element to be attached in each case between the housing base and/or the housing cover and/or the housing wall and the insert in the first filter chamber and the nth filter chamber, the same preventing these elements from turning with respect to each other. This ensures that the resonance frequencies and the group delays of the individual resonators do not change over time due to vibration in the high-frequency filter.

The n dielectrics inside the multiplex filter can have a disk shape, and/or all or some of the n dielectrics can have completely or partially differing dimensions. It is also possible for all or at least one of the n dielectrics to fully or partially fill in the volume of their respective filter chambers, and therefore of the m resonator chambers. The behavior of each resonator with respect to its resonance frequency and its coupling bandwidth can be accordingly adjusted by the geometric form and the arrangement of the dielectrics.

The dividing device is preferably formed by a plurality of through-connections inside the dielectric, which are arranged in the filter chamber parallel, or at least with one component parallel, to the central axis, thereby dividing the dielectric into m parts, wherein each of the m parts is found in one of the m resonator chambers of a filter chamber. This enables the use of a single dielectric, which is preferably made of a ceramic. In contrast, it would be possible for the dielectric to be composed inside each filter chamber of m parts which are preferably the same size, wherein each of the m parts is found in one of the m resonator chambers in a filter chamber, and wherein a metal layer is formed inside each filter chamber between the m parts as a dividing device. This metal layer separates the individual resonator chambers inside a filter chamber from each other, wherein the metal layer is arranged parallel to, or at least with one component parallel to, the central axis. A metal layer can be, by way of example, an electrically conductive coating on the lateral peripheral surface of the dielectric. Such an electrically conductive coating must be applied only at the locations of the m parts which are not in contact with the insert or with another already coated part of the m parts.

At least two or all of the n dielectrics, or two or all of the m parts of at least one dielectric, are made of a different material. In this case, it is also possible that at least one or all of the n dielectrics preferably have at least one recess filled with air. In this way, it is possible to separately change the resonance frequency for each resonator of a resonator chamber inside a filter chamber.

The first filter chamber has a region in which the dividing device only extends through the first dielectric over a sub-length of the diameter, thereby forming an opening region in which the common connection is coupled in the first filter plane to all m resonators, wherein the opening region has a size or length which is less than 10%, preferably less than 20%, more preferably less than 30%, more preferably less than 40%, and more preferably less than 50% of the smallest diameter of the first filter chamber. In this way, it is possible for a common connection to be used as a shared connector. By way of example, a mobile radio antenna can be connected to the common connection, wherein signals are transmitted via the same and signals are received by the same.

The signal transmission direction runs through each of the m signal line connections either from the signal line connection to the common connection or from the common connection to the signal line connection. If the signal transmission direction runs from one or more of the signal line connections to the common connection, one resonator of one resonator chamber of a filter chamber is coupled to precisely one resonator of one resonator chamber of a filter chamber which is adjacent in the signal transmission direction. This ensures that one resonator chamber is coupled to precisely one further resonator chamber along the route toward the common connection in the signal transmission direction. In the opposite direction, in the case in which the signal transmission direction runs from the common connection to one or more of the m signal line connections, one resonator of one resonator chamber of a filter chamber is coupled to one or more resonators of one filter chamber which is adjacent in the signal transmission direction. This means that in this case one resonator of one resonator chamber is coupled to more than one resonator of multiple resonator chambers of a further filter chamber. As such, it is possible to create additional signal transmission paths. However, this is preferably only true if the signal transmission direction runs from the common connection to the m signal line connections.

The coupling between the individual resonators is increased by the dielectric in the first resonator being in contact with the first separator, and the dielectric in the nth resonator being in contact with the n−1th separator, wherein the remaining dielectrics of the remaining n−2 resonators are in contact with both of the separators bounding the filter chamber in question. This is particularly advantageous if the dielectric in the first resonator is additionally in contact with the housing cover and the dielectric in the nth resonator is in contact with the housing base. The phrase "in contact" is used to indicate that two entities at least touch. The dielectrics of the n filter chambers in this case are preferably fixed to the respective separator or the respective separators, thereby improving the coupling.

In a further embodiment of the multiplex filter, the common connection contacts the dielectric in the first filter chamber either centrally or off-center. The dielectric in the first filter chamber has a depression into which the common connection projects, and as a result the common connection is in contact with the first dielectric, or the dielectric in the first filter chamber has a recess which passes through the same, through which the common connection extends such that the common connection is in contact with the first dielectric and is in contact with the first separator. The same is true for the m signal line connections. These have a central or off-center contact with the dielectric which is arranged in the m resonator chambers of the nth filter chamber. The dielectric in the nth filter chamber has up to m depressions into which the m signal line connections project, and as a result the m signal line connections are in contact with the nth dielectric, and/or the dielectric in the nth filter chamber has up to m recesses passing through the same, through which the m signal line connections extend such that the m signal line connections are in contact with the nth dielectric and are in contact with the n−1th separator.

A further advantage of the multiplex filter is a result of the fact that the arrangement and/or the size and/or cross-section shape of at least one coupling opening of one of the n−1 separators differs entirely or partially from the arrangement and/or the size and/or the cross-section shape of another coupling opening of the same n−1 separator or from a coupling opening of another of the n−1 separators. As an alternative or in addition thereto, the number of the coupling openings in the n−1 separators can be entirely or partially different among the same, and/or the number of the coupling openings of one of the n−1 separators used for the coupling of a resonator is different from the number of the coupling openings of the same separator used for the coupling of another resonator. This enables an adjustment of the coupling between the individual resonators to the desired value.

For further tuning of the high-frequency filter, it is also possible that at least one, and preferably all of the resonator chambers of at least one, and preferably all of the filter chambers have at least one additional opening toward the outside of the housing, wherein at least one tuning element can be inserted via this additional opening into the resonator chamber of at least one filter chamber. The distance between the tuning element which is inserted through the at least one additional opening into the at least one resonator chamber of at least one filter chamber can be modified for the corresponding, respective dielectric inside the at least one resonator chamber in the at least one filter chamber. In this case, multiple tuning elements can also be inserted into one resonator chamber, wherein one tuning element consists, by way of example, entirely of a metal or a metallic coating, whereas the other tuning element comprises a dielectric material. The tuning element which consists of a metallic material can be used for coarse tuning, and the tuning element which comprises a dielectric material can be used for fine tuning of the resonator frequency and/or the coupling bandwidth of the corresponding resonator.

In this case, the distance between the at least one spacer element and the respective dielectric inside the at least one of the m resonator chambers of the at least one of the n filter chambers can also be reduced to such an extent that it is in direct contact with the same. The dielectric of at least one of the n filter chambers can also have at least one indentation, wherein the distance between the tuning element and the dielectric can be reduced in such a manner that the tuning element dips into the indentation of the respective dielectric and is in contact with the same. The tuning element in this case enters into the at least one of the m resonator chambers of at least one of the n filter chambers particularly perpendicularly to the signal transmission direction—that is, preferably perpendicular to the central axis.

A method for tuning the multiplex filter is accordingly repeated for the remaining filter chambers. After the resonance frequency and/or the coupling bandwidth of at least one resonator, and preferably all resonators in the first and/or last—that is, nth—filter chamber have been adjusted to the desired value, in a further method stop at least one, and preferably m or more coupling openings of the 1+Xth separator and/or the n−1−Xth separator are opened. Then the value of the counter variable X is increased by 1. The previous method steps are then carried out once more. Once again, a reflection factor is measured on the common connection and/or a reflection factor is measured on at least one, and preferably on all m signal line connections. Subsequently, the coupling openings to the following resonators in the following filter chambers are opened and the value of the counter variable is once again increased. The tuning of the multiplex filter begins with the resonators into which the common connection and the m signal line connections engage—that is, with the resonators of the outermost filter chamber—and ends with the resonators which are arranged in the filter chamber (for an odd number n) or the filter chambers (for an even number n) in the center of the multiplex filter.

In the event that the multiplex filter has an uneven number of filter chambers, the filter chambers in the center of the multiplex filter must be utilized once for the measurement of the reflection factor on the common connection, and another time for the measurement of the reflection factor on at least one, and preferably all, of the m signal line connections. The coupling openings of the two separators which surround the filter chamber in the center of the multiplex filter must be closed to the other connector in each case—that is, to the common connection or to at least one, and preferably all, of the m signal line connections, according to the measurement of the respective reflection factor.

Subsequently, or if, for an even number of filter chambers, all coupling openings are open, the forward transmission factor and/or the reverse transmission factor can be measured, in addition to the reflection factors on the common connection and/or on at least one, and preferably all, of the m signal line connections.

The resonance frequencies and/or the coupling bandwidths can be modified for each resonator chamber of a filter chamber and thereby for each resonator in a filter chamber by modifying the diameter of at least one resonator chamber of a filter chamber, which is possible, by way of example, by exchanging the at least one insert for another insert with a modified size. The arrangement and/or the number and/or the size and/or the cross-section shape of the at least one coupling opening can also be modified by turning and/or exchanging the at least one separator. Likewise, the resonance frequency and/or the coupling bandwidth can be modified by rotating inward or outward at least one tuning element into/out of at least one resonator chamber of a filter chamber. Finally, the dielectric in a filter chamber can be exchanged for another dielectric with modified dimensions and/or recesses.

Various non-limiting embodiments are described in detail below as examples with reference to the drawings. Objects which are the same have the same reference numbers. In the corresponding figures of the drawings,

BRIEF DESCRIPTION OF THE DRAWINGS

The following detailed description of exemplary non-limiting illustrative embodiments is to be read in conjunction with the drawings of which.

DETAILED DESCRIPTION OF EXAMPLE NON-LIMITING EMBODIMENTS

Figure 1:
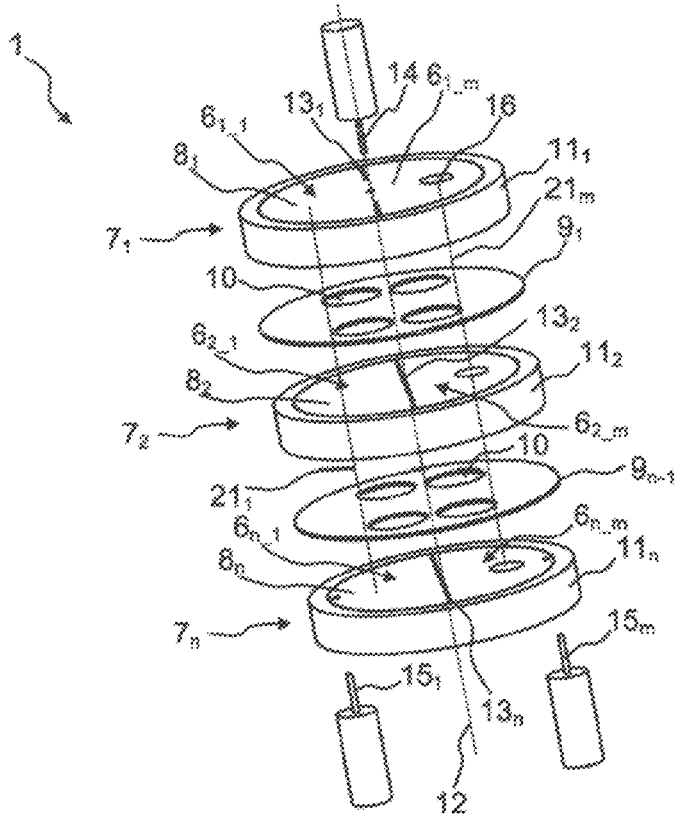
FIG. 1: shows an exploded drawing of a multiplex filter.

FIG. 1 shows one embodiment of the multiplex filter 1 in an exploded view. The multiplex filter 1 has a housing 2 which has a housing base 3, a housing cover 4 spaced apart from the housing base 3, and a circumferential housing wall 5 between the housing base 3 and the housing cover 4. For better viewability, in FIG. 1 the housing 2, together with the housing base 3, the housing cover 4, and the housing wall 5, are not shown. These are shown beginning in FIG. 6A. Both the housing cover 4 and the housing base 3 have at least one opening via which the one common connection 14 and the up to m signal line connections 15 can be inserted. In this case, a common connection 14 is fed to the multiplex filter 1 through the opening of the housing cover 4, and up to m further signal line connections 15 are fed through m openings in the housing base 3. The opening in the housing cover 4 need not be arranged in the center of the housing cover 4. It is also possible that the opening is arranged off-center.

The multiplex filter 1 also has n filter chambers $\mathbf{7}_1$, $\mathbf{7}_2$, . . . , $\mathbf{7}_n$. n is a natural number, wherein n≥1, preferably n≥2, more preferably n≥3, more preferably n≥4, more preferably n≥5. In each of the n filter chambers $\mathbf{7}_1$, $\mathbf{7}_2$, . . . , $\mathbf{7}_n$ are arranged up to m resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$. m is likewise a natural number, wherein m≥1, preferably m≥2, more preferably m≥3, more preferably m≥4, and more preferably m≥5.

Regarding the nomenclature use, for a term such as $\mathbf{6}_{1_m}$, the first subscript number—in this case "1"—indicates the number of the filter chamber $\mathbf{7}_1$, $\mathbf{7}_2$, . . . , $\mathbf{7}_n$ and the value for this number can therefore range up to "n." The second number, in this case "m," indicates the number of the resonator chamber insides the respective filter chamber $\mathbf{7}_1$, $\mathbf{7}_2$, . . . , $\mathbf{7}_n$ and can therefore range up to "m." Using such a nomenclature, it is possible to address all resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$ inside the filter chambers $\mathbf{7}_1$, $\mathbf{7}_2$, . . . , $\mathbf{7}_n$.

At least one dielectric $\mathbf{8}_1$, $\mathbf{8}_2$, . . . , $\mathbf{8}_n$ is positioned inside each filter chamber $\mathbf{7}_1$, $\mathbf{7}_2$, . . . , $\mathbf{7}_n$. This dielectric $\mathbf{8}_1$, $\mathbf{8}_2$, . . . , $\mathbf{8}_n$ preferably has a disk-shaped or cylindrical design. It extends over the entire volume of the respective filter chamber $\mathbf{7}_1$, $\mathbf{7}_2$, . . . , $\mathbf{7}_n$, or only over a part thereof.

The individual resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$ of each filter chamber $\mathbf{7}_1$, $\mathbf{7}_2$, . . . , $\mathbf{7}_n$ are decoupled from each other by means of n dividing devices $\mathbf{13}_1$, $\mathbf{13}_2$, . . . , $\mathbf{13}_n$. The at least one dividing device is arranged parallel to the central axis and divides the filter chamber into m resonator chambers parallel to the central axis. These dividing devices $\mathbf{13}_1$, $\mathbf{13}_2$, . . . , $\mathbf{13}_n$ are preferably arranged parallel to the central axis 12 and/or parallel to the m signal transmission devices $\mathbf{21}_1$, . . . $\mathbf{21}_m$, and therefore divide each of the n filter chambers $\mathbf{7}_1$, $\mathbf{7}_2$, . . . , $\mathbf{7}_n$ parallel to the central axis 12 into m resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$.

The n dividing devices $\mathbf{13}_1$, $\mathbf{13}_2$, . . . , $\mathbf{13}_n$ are, by way of example, formed by a plurality of through-connections inside the dielectric $\mathbf{8}_1$, $\mathbf{8}_2$, . . . , $\mathbf{8}_n$. The through-connections are arranged in the dielectrics $\mathbf{8}_1$, $\mathbf{8}_2$, . . . , $\mathbf{8}_n$, the same arranged in the filter chambers $\mathbf{7}_1$, $\mathbf{7}_2$, . . . , $\mathbf{7}_n$, parallel to, or at least with one component parallel to, the central axis 12 and/or to one of the signal transmission directions $\mathbf{21}_2$, . . . $\mathbf{21}_m$. As a result, the n dielectrics $\mathbf{8}_1$, $\mathbf{8}_2$, . . . , $\mathbf{8}_n$ are divided into m parts, and each of the m parts is in one of the m resonator chambers $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$. It can also be said that the m resonator chambers $6_{1_1}$, $6_{1_2}$, . . . , $6_{1_m}$, to $6_{n_1}$, $6_{n_2}$, . . . , $6_{n_m}$ are created by the n dividing devices $13_1$, $13_2$, . . . , $13_n$. The through-connections are preferably bore holes with inner walls which are galvanized with an electrically conducting layer. The through-connections can be arranged in a row. However, multiple rows of through-connections can also be arranged parallel and directly adjacent to each other.

It is also possible for the dielectric $8_1$, $8_2$, . . . , $8_n$ to be composed inside each filter chamber $7_1$, $7_2$, . . . , $7_n$ of m parts which are preferably the same size, wherein each of the m parts is found in one of the m resonator chambers $6_{1_1}$, $6_{1_2}$, . . . , $6_{1_m}$, to $6_{n_1}$, $6_{n_2}$, . . . , $6_{n_m}$ in a filter chamber $7_1$, $7_2$, . . . , $7_n$. A metal layer is formed inside each filter chamber $7_1$, $7_2$, . . . , $7_n$ between the m parts, forming the dividing device $13_1$, $13_2$, . . . , $13_n$. As a result, the individual resonator chambers $6_{1_1}$, $6_{1_2}$, . . . , $6_{1_m}$, to $6_{n_1}$, $6_{n_2}$, . . . , $6_{n_m}$ inside a filter chamber $7_1$, $7_2$, . . . , $7_n$ are separated from each other, wherein the metal layer is arranged parallel to, or at least with one component parallel to, the central axis 12 or to a signal transmission direction $21_1$, . . . $21_m$. The metal layer can be, by way of example, an electrically conductive coating. Preferably only the specific surfaces of the lateral peripheral surfaces of the m parts are coated which directly adjoin other m parts of the dielectric $8_1$, $8_2$, . . . , $8_n$ which are not coated with such an electrically conductive layer. Of course, all of the lateral peripheral surfaces of the m parts can also be coated with the electrically conductive layer.

In this context, it is also possible that two, or all, of the m parts which together form one of the n dielectrics $8_1$, $8_2$, . . . , $8_n$ inside the filter chamber $7_1$, $7_2$, . . . , $7_n$ are made of a different material. The same is naturally also true for the n dielectrics $8_1$, $8_2$, . . . , $8_n$ themselves, in the event they are constructed as separate parts.

The m parts of one of the n dielectrics $8_1$, $8_2$, . . . , $8_n$, or the n dielectrics $8_1$, $8_2$, . . . , $8_n$ constructed as separate parts, have one or more recesses 16 which are preferably filled with air. Rather than being filled with air, these recesses 16 can also be filled with a material which has a permeability which differs from a permeability of the n dielectrics $8_1$, $8_2$, . . . , $8_n$.

The individual filter chambers $7_1$, $7_2$, . . . , $7_n$ are separated from each other by separators $9_1$, $9_2$, . . . $9_{n-1}$. These separators $9_1$, $9_2$, . . . $9_{n-1}$ are preferably separating disks. These separators $9_1$, $9_2$, . . . $9_{n-1}$ consist of an electrically conductive material or are coated with such a material. Each of these separators $9_1$, $9_2$, . . . $9_{n-1}$ has at least one coupling opening 10. The size, the geometric shape, the number, and the arrangement of the coupling opening 10 inside the respective separator $9_1$, $9_2$, . . . $9_{n-1}$ can be selected arbitrarily and can differ from one separator $9_1$, $9_2$, . . . $9_{n-1}$ to another separator $9_1$, $9_2$, . . . $9_{n-1}$. The diameter of the coupling openings 10 is, by way of example, only a fraction of a millimeter according to the frequency range. It can—particularly for low frequencies—also be multiple millimeters. The separators $9_1$, $9_2$, . . . $9_{n-1}$ are preferably thinner that the dielectrics $8_1$, $8_2$, . . . , $8_n$. The separators $9_1$, $9_2$, . . . $9_{n-1}$ are preferably only several millimeters thick. They are preferably thinner than 3 millimeters, and they are more preferably thinner than 2 millimeters.

Each filter chamber $7_1$, $7_2$, . . . , $7_n$ can also have at least one insert $11_1$, $11_2$, . . . , $11_n$. Such an insert $11_1$, $11_2$, . . . , $11_n$ is preferably a ring which is preferably supported in a form-fitting manner by its outer surface on an inner surface of the housing wall 5. Such an insert $11_1$, $11_2$, . . . , $11_n$, which is electrically conductive, can be used to adjust the volume of the filter chamber $7_1$, $7_2$, . . . , $7_n$ and therefore to adjust the volume of the individual resonator chambers $6_{1_1}$, $6_{1_2}$, . . . , $6_{1_m}$, to $6_{n_1}$, $6_{n_2}$, . . . , $6_{n_m}$, and thereby enables the adjustment of the resonance frequency of the multiplex filter.

In the embodiment in FIG. 1, a central axis 12 is also illustrated which runs through the multiplex filter 1. The central axis 12 in this case passes through the entire housing 2, particularly the housing base 3 and the housing cover 4. Preferably, all filter chambers $7_1$, $7_2$, . . . , $7_n$ are intersected by the central axis 12 either centrally or off-center. In the embodiment in FIG. 1, there are two signal transmission directions $21_1$ and $21_2$, because m assumes the value of "2." There are fundamentally "m" signal transmission directions $21_1$, $21_2$, . . . , $21_m$. The signal transmission directions $21_1$, $21_2$, . . . , $21_m$ preferably run parallel to the central axis 12. The filter chambers $7_1$, $7_2$, . . . , $7_n$ in this case are arranged one above the other. Each filter chamber $7_1$, $7_2$, . . . , $7_n$ therefore has a maximum of two directly adjacent filter chambers $7_1$, $7_2$, . . . , $7_n$, and the filter chambers $7_1$, $7_2$, . . . , $7_n$ are separated from each other by each respective separator $9_1$, $9_2$, . . . $9_{n-1}$. The individual resonators of the resonator chambers $6_{1_1}$, $6_{1_2}$, . . . , $6_{1_m}$, to $6_{n_1}$, $6_{n_2}$, . . . , $6_{n_m}$ of two filter chambers $7_1$, $7_2$, . . . , $7_n$ can only be coupled via the respective coupling openings inside the separators $9_1$, $9_2$, . . . $9_{n-1}$. It is not possible to couple the individual resonators of the resonator chambers $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$, and/or the coupling is weaker by more than a factor of 100, and preferably by more than a factor of 1000, than the coupling of two resonators of two resonator chambers $6_{1_1}$, $6_{1_2}$, . . . , $6_{1_m}$, to $6_{n_1}$, $6_{n_2}$, . . . , $6_{n_m}$6 which are coupled to each other via the coupling openings 10 inside the separators $9_1$, $9_2$, . . . $9_{n-1}$.

The individual resonators of the resonator chambers $6_{1_1}$, $6_{1_2}$, . . . , $6_{1_m}$, to $6_{n_1}$, $6_{n_2}$, . . . , $6_{n_m}$ in this case are coupled parallel to the respective signal transmission direction $21_1$, $21_2$, . . . , $21_m$. The H field 20 in this case propagates perpendicular to the respective signal transmission direction $21_1$, $21_2$, . . . , $21_m$.

All filter chambers $7_1$, $7_2$, . . . , $7_n$ are intersected by the central axis 12. The central axis 12 in this case meets the end face of each dielectric $8_1$, $8_2$, . . . , $8_n$ inside the filter chambers $7_1$, $7_2$, . . . , $7_n$ at a right angle.

The inner wall of the housing 5 of the multiplex filter 1 is preferably cylindrical in cross-section. The same is also true for the inner wall of each insert $11_1$, $11_2$, . . . , $11_n$. However, other cross-section shapes are also possible. By way of example, the inner walls can have the cross-section shape, viewed from above, of a rectangle or a square or an oval or a regular or irregular n-polygon, or approximately the same.

The signal transmission direction $21_1$, . . . $21_m$ runs through each of the m signal line connections $15_1$, $15_2$, . . . , $15_m$ either from the signal line connection $15_1$, $15_2$, . . . , $15_m$ to the common connection 14 or from the common connection 14 to the signal line connection $15_1$, $15_2$, . . . , $15_m$. The signal transmission direction $21_1$, . . . $21_m$ can run in a different direction for each of the individual signal line connections $15_1$, $15_2$, . . . , $15_m$. The signal transmission direction $21_1$, . . . $21_m$ runs from one or more of the signal line connections $15_1$, $15_2$, . . . , $15_m$ to the common connection 14, wherein one resonator of one resonator chamber $6_{1_1}$, $6_{1_2}$, . . . , $6_{1_m}$, to $6_{n_m}$, $6_{n_2}$, . . . , $6_{n_m}$ of a filter chamber $7_1$, $7_2$, . . . , $7_n$ is coupled to precisely one resonator of one resonator chamber $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ which is adjacent in the signal transmission direction $21_1$, . . . $21_m$. This circumstance is shown in FIG. 1 as well. Each resonator chamber $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ is coupled via at least one coupling opening 10 of one of the n−1 separators $9_1$, $9_2$, . . . $9_{n-1}$ to exactly one further resonator chamber $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ which is adjacent in the signal transmission direction $21_1$, $21_m$.

In FIG. 1, this is true both when the signal transmission direction $21_1$, . . . $21_m$ runs from one or from more of the m signal line connections $15_1$, $15_2$, . . . , $15_m$ to the common connection 14, and when the signal transmission direction $21_1$, . . . $21_m$ runs from the common connection 14 to one or more m signal line connections $15_1$, $15_2$, . . . , $15_m$.

In an embodiment which is not illustrated, individual resonator chambers $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ can be coupled in the signal transmission direction $21_1$, . . . $21_m$ to more than just one resonator chamber $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ arranged in the signal transmission direction $21_1$, . . . $21_m$. In this case, the signal transmission direction $21_1$, . . . $21_m$ runs from the common connection 14 to one or more of the m signal line connections $21_1$, . . . $21_m$, wherein one resonator of one resonator chamber $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$ is coupled to one or more resonators of one filter chamber $7_1$, $7_2$, . . . , $7_n$ which is adjacent in the signal transmission direction $21_1$, . . . $21_m$. As a result, it is possible for at least two signal transmission paths to run through individual resonator chambers $6_{1_1}$, $6_{1_2}$, . . . , $6_{1_m}$, to $6_{n_1}$, $6_{n_2}$, . . . , $6_{n_m}$ of a filter chamber $7_1$, $7_2$, . . . , $7_n$.

The n−1 separators $9_1$, $9_2$, . . . $9_{n-1}$ preferably comprise a separating plate which is made of metal. The coupling openings 10 can be created in this separating plate by means of a laser or a punching process, or a milling process, by way of example.

Figure 2:
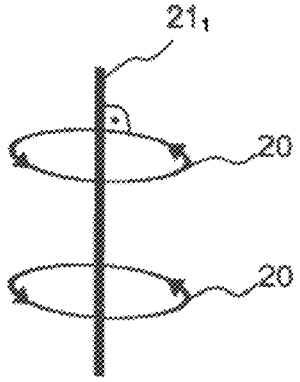
FIG. 2: shows an illustration which explains that a magnetic field is arranged perpendicular to the signal transmission direction.

FIG. 2 shows an illustration which explains that a magnetic field (H field) is arranged perpendicular to the signal transmission direction $21_1$. The magnetic field lines in this case propagate radially outward about the signal transmission direction $21_1$. The central axis 12 and the signal transmission direction $21_1$ in the embodiment in FIG. 1 do not cover the same area, but are parallel to each other. The same is also true for the further signal transmission direction $21_1$, . . . $21_m$ with respect to the central axis 12.

Figure 3A:
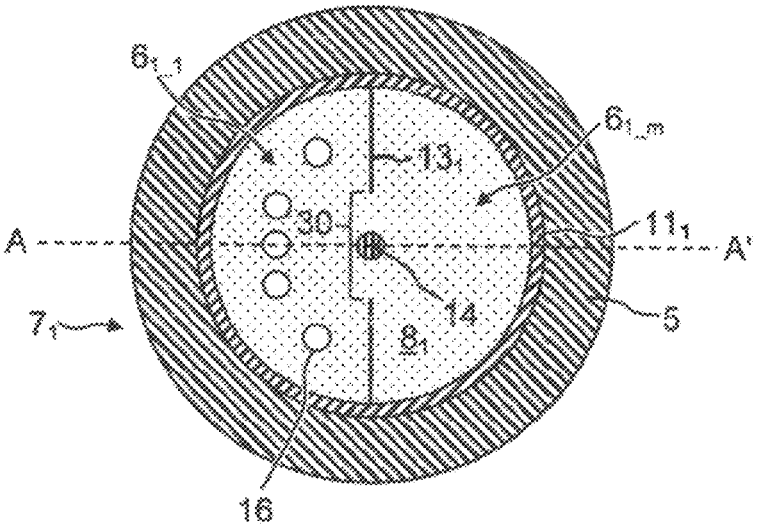
FIG. 3A: shows a cross-section through the first filter chamber with two resonator chambers, wherein the dielectric of a resonator chamber has multiple recesses.

FIG. 3A shows a cross-section through the first filter chamber $7_1$ with two resonator chambers $6_{1_1}$, $6_{1_m}$, wherein the dielectric $8_1$ of a resonator chamber $6_{1_1}$ has multiple recesses 16.

The volume of the first filter chamber $7_1$ is bounded by a first insert $11_1$, and the first insert $11_1$ is arranged adjacent thereto on an inner wall of the housing wall 5. The common connection 14 is centered—that is, arranged centrally in the first filter chamber $7_1$ and coupled to the same. The common connection 14 couples to the first and second (m=2) resonator chambers $6_{1_1}$, $6_{1_m}$, wherein the first resonator chamber has a plurality of recesses 16. These recesses 16 are preferably filled with air and are arranged symmetrically with respect to an axis A-A'. The axis A-A' runs transverse to the central axis 12 and divides the first resonator chamber $6_{1_1}$ into two identical regions. The m resonator chambers $6_{1_1}$, $6_{1_m}$ of the first filter chamber $7_1$ are the same size. This is also true for the further m resonator chambers $6_{1_1}$, $6_{1_m}$ of the further filter chambers $7_2$, . . . , $7_n$. Also, the m resonator chambers $6_{1_1}$, $6_{1_m}$ of the n filter chambers $7_1$, $7_2$, . . . , $7_n$ can have different sizes.

The first filter chamber $7_1$ comprises a region in which the dividing device $13_1$ only extends through the first dielectric $8_1$ by a sub-length of the diameter. This forms an opening region 30 in which the common connection 14 is coupled to all m resonators of the m resonator chambers $6_{1_1}$, $6_{1_m}$ in the first filter chamber $7_1$. The opening region 30 has a size or length which is less than 10%, preferably less than 20%, more preferably less than 30%, more preferably less than 40%, and more preferably less than 50% of the smallest diameter of the first filter chamber $7_1$.

Depending on the desired strength of the coupling in one of the m resonator chambers $6_{1_1}$, $6_{1_m}$, the common connection can be arranged near to one or nearer to the other resonator chamber $6_{1_1}$, $6_{1_m}$, and therefore off-center. The first dividing device $13_1$ can also be designed in such a manner that the coupling between the common connection 14 and one of the two resonator chambers $6_{1_1}$, $6_{1_m}$ is stronger than the coupling to the other.

Figure 3B:
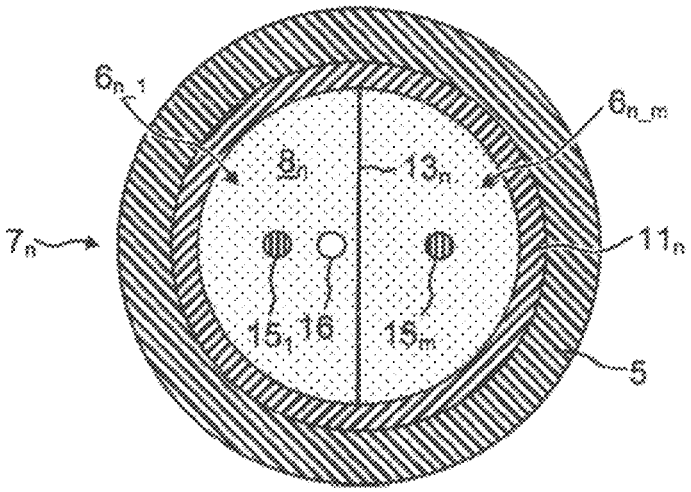
FIG. 3B: shows a cross-section through the nth filter chamber with two resonator chambers, wherein the dielectric of a resonator chamber has multiple recesses.

FIG. 3B shows a cross-section through the nth filter chamber $7_n$ with two resonator chambers $6_{n_1}$, $6_{n_m}$, wherein the dielectric $8_n$ of the filter chamber $7_n$ has a recess 16 in the region of one resonator chamber $6_{n_1}$. The figure also shows that the insert $11_n$ has a smaller inner diameter than the insert $11_1$ in FIG. 3A. This means that the volume of the nth filter chamber $7_n$ is less than the volume of the first filter chamber $7_1$ in FIG. 3A. In contrast to FIG. 3A, there is no opening region 30. The signal line connections $15_1$, $15_m$ (in this case, m=2) are arranged off-center on the housing base 3, which is not illustrated, and are therefore off-center on the dielectric $8_n$.

The number of recesses 16 in each resonator chamber $6_{n_1}$, $6_{n_m}$ can partially or entirely differ from the number of the recesses in the other resonator chambers $6_{n_1}$, 6 nm of the same filter chamber $7_n$.

Figure 4A:
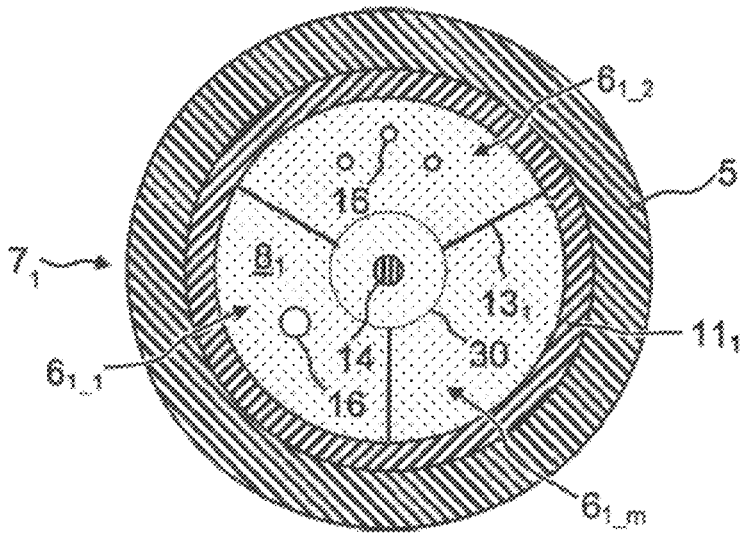
FIGS. 4A, 4B: show a cross-section through the first and the nth filter chamber with three resonator chambers, each of which are the same size.

FIG. 4A shows a cross-section of the first filter chamber $7_1$, wherein the common connection 14 is coupled to three resonator chambers $6_{1_1}$, $6_{1_2}$, $6_{1_m}$ of the first filter chamber $7_1$, all of which have the same size. The dividing device $13_1$ in this case consists of m bars which are arranged apart from each other by a measure of $\alpha$=360°/m. Again, an opening region 30 is formed around the common connection 14, which in this case is characterized by a diameter rather than by a length, wherein the diameter is less than 10%, preferably less than 20%, more preferably less than 30%, more preferably less than 40%, and more preferably less than 50% of the smallest diameter of the first filter chamber $7_1$. The dividing device $13_1$ is not constructed inside this opening region 30, such that there can be a coupling between the common connection 14 and the m resonator chambers $6_{1_1}$, $6_{1_2}$, $6_{1_m}$. The points of the dotted opening region 30 have no through-connections of any kind, and only serve to symbolize the opening region 30.

The m resonator chambers $6_{1_1}$, $6_{1_2}$, $6_{1_m}$ have a different number of recesses 16 which in turn have, at least to some degree, different sizes.

Figure 4B:
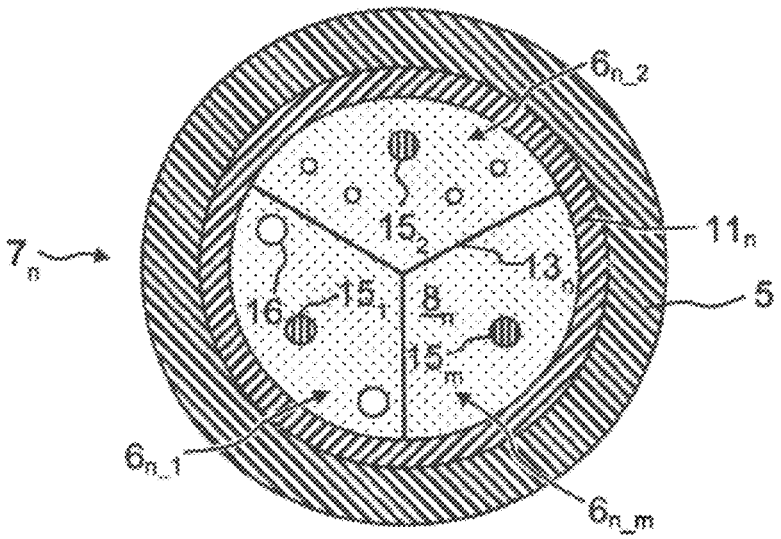

FIG. 4B shows a cross-section through the nth filter chamber $7_n$ with three resonator chambers $6_{n_1}$, $6_{n_2}$, $6_{n_m}$, each of which are the same size. The m resonator chambers $6_{n_1}$, $6_{n_2}$, 6 nm are not coupled to each other. One of the m signal line connections $15_1$, $15_2$, . . . , $15_m$ is situated inside each of these m resonator chambers $6_{n_1}$, $6_{n_2}$, 6 nm to establish a coupling in or out of the same. The dielectric $8_m$ has a different number of recesses 16, which differ at least to some degree in their sizes, and the recesses 16 are each arranged in different resonator chambers $\mathbf{6}_{n_1}$, $\mathbf{6}_{n_2}$, $\mathbf{6}_{n_m}$.

The recesses 16 can pass entirely through the dielectric 8*m*, or rather can be formed as blind holes.

Figure 5A:
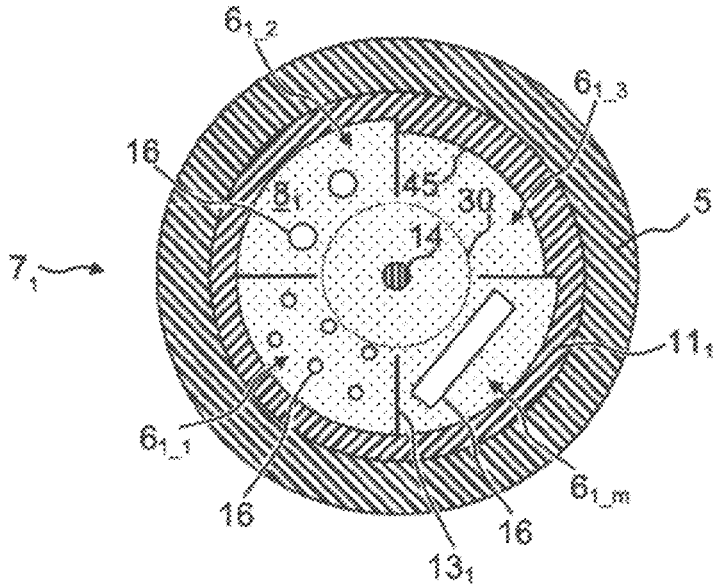
FIG. 5A: shows a cross-section through the first filter chamber with four resonator chambers, wherein the insert has a wall segment with different thicknesses such that the volumes of the individual resonator chambers differ.

FIG. 5A shows a cross-section through the first filter chamber $\mathbf{7}_1$ with four resonator chambers $\mathbf{6}_{1_1}$, $\mathbf{6}_{1_2}$, $\mathbf{6}_{1_3}$, $\mathbf{6}_{1_m}$, wherein the insert $\mathbf{11}_1$ has a wall segment 45 with thicknesses which differs from the thickness of the other wall segments such that the volumes of the at least one resonator chamber $\mathbf{6}_{1_3}$ differ from the volumes of the other resonator chambers $\mathbf{6}_{n_1}$, $\mathbf{6}_{n_2}$, $\mathbf{6}_{n_m}$. The thicknesses of the at least one wall segment 45 can also alternate. By way of example, in the cross-section shown in FIG. 5A, the wall segment can have a sawtooth profile.

The opening region 30 is selected in such a manner that the common connection 14 is coupled to all m resonators of the m resonator chambers $\mathbf{6}_{1_1}$, $\mathbf{6}_{1_2}$, $\mathbf{6}_{1_3}$, $\mathbf{6}_{1_m}$, wherein the m resonator chambers $\mathbf{6}_{11}$, $\mathbf{6}_{1_2}$, $\mathbf{6}_{1_3}$, $\mathbf{6}_{1_m}$ have a different number of recesses 16, which differ entirely, or to some degree, from each other in both their number and their size, as well as in their shape. The inner walls 16 can have the cross-section shape, viewed from above, of a rectangle and/or a square and/or an oval and/or a regular or irregular n-polygon, or approximately the same. The corners of these recesses 16 can also be rounded off, for example.

The dividing device $\mathbf{13}_1$ consists of m bars which are arranged with a spacing from each other, wherein the individual bars are spaced from each other by a measure of $\alpha$=360°/m. In this case, the bars are spaced apart by 90°.

Figure 5B:
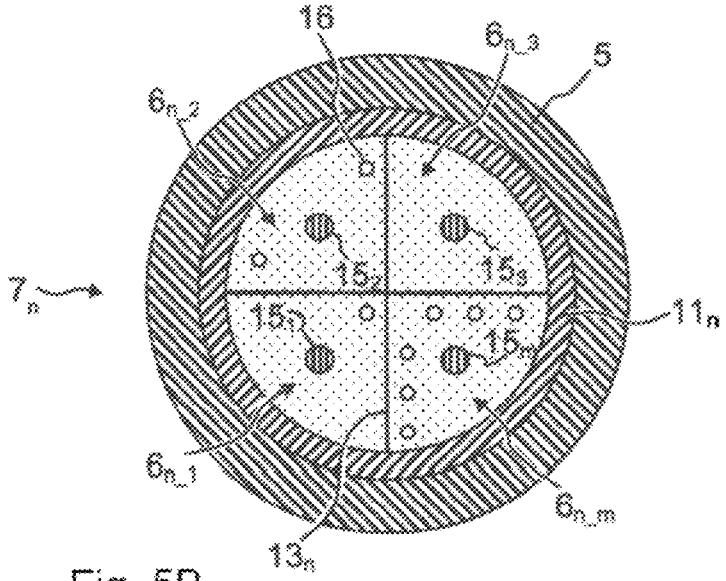
FIG. 5B: shows a cross-section through the nth filter chamber with four resonator chambers, each of which are the same size but have different numbers of recesses.

FIG. 5B shows a cross-section through the nth filter chamber $\mathbf{7}_n$ with four resonator chambers $\mathbf{6}_{n_1}$, $\mathbf{6}_{n_2}$, $\mathbf{6}_{n_3}$, $\mathbf{6}_{n_m}$, each of which are the same size but have different numbers of recesses 16. The dividing device $\mathbf{11}_n$ prevents the individual resonator chambers $\mathbf{6}_{n_1}$, $\mathbf{6}_{n_2}$, $\mathbf{6}_{n_3}$, $\mathbf{6}_{n_m}$ from being coupled to each other. The dividing device $\mathbf{11}_n$ consists of m bars which are preferably connected to each other in the center—that is, in the center of the nth filter chamber $\mathbf{7}_n$. One of the n signal line connections $\mathbf{15}_1$, $\mathbf{15}_2$, $\mathbf{15}_3$, $\mathbf{15}_m$ is coupled to each of the m resonator chambers $\mathbf{6}_{n_1}$, $\mathbf{6}_{n_2}$, $\mathbf{6}_{n_3}$, $\mathbf{6}_{n_m}$.

Figure 6A:
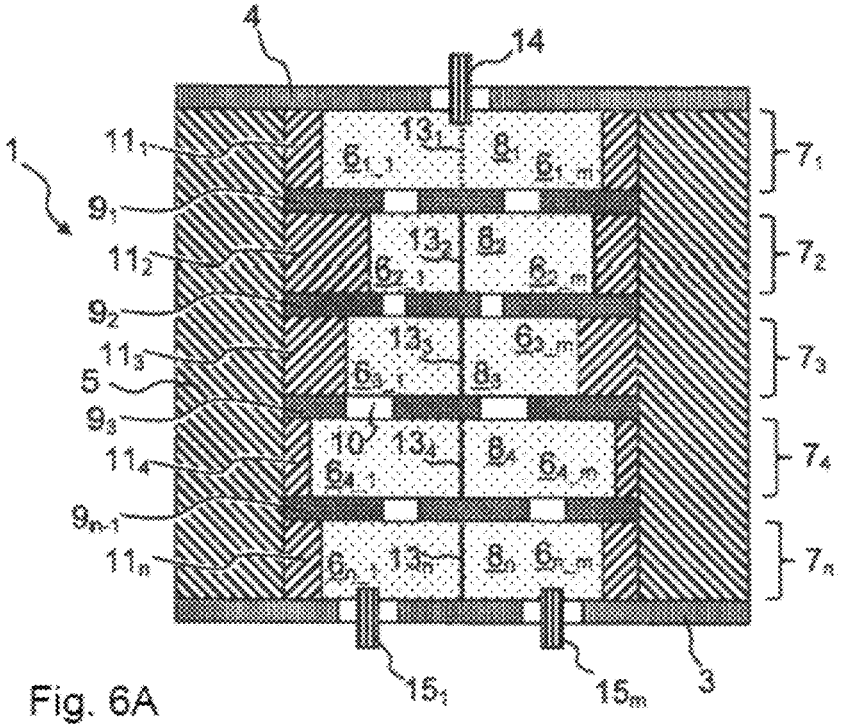
FIG. 6A: shows a longitudinal cross-section of a further embodiment of the multiplex filter, wherein the inserts have different inner diameters and the dielectrics completely fill in all of the filter chambers.

FIG. 6A shows a longitudinal cross-section through the multiplex filter 1, showing multiple filter chambers $\mathbf{7}_1$, $\mathbf{7}_2$, . . . , $\mathbf{7}_n$ each with resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$ which are coupled to each other via coupling openings 10 in the separator $\mathbf{9}_1$, $\mathbf{9}_2$, . . . $\mathbf{9}_{n-1}$. The common connection 14 is inserted through an opening in the housing cover 4 into the first filter chamber $\mathbf{7}_1$. On the other side, each of the m signal line connections $\mathbf{15}_1$, . . . , $\mathbf{15}_m$ is guided through one opening in the housing base 3 and coupled to the m resonators $\mathbf{6}_{n_1}$, . . . , $\mathbf{6}_{n_m}$ of the nth filter chamber $\mathbf{7}_n$.

There is no distance between the first dielectric $\mathbf{8}_1$ and the housing cover 4. The same is true for the nth dielectric $\mathbf{8}_n$ which is likewise in contact with the housing base 3 via its end face. There is no distance between the nth dielectric $\mathbf{8}_n$ and the housing base 3. The elements of the high-frequency filter 1—that is, by way of example, the inserts $\mathbf{11}_1$, . . . , $\mathbf{11}_n$, the dielectrics $\mathbf{8}_1$, . . . , $\mathbf{8}_n$, the separators $\mathbf{9}_1$, . . . , $\mathbf{9}_{n-1}$ and the housing cover 4 and/or the housing base 3—are preferably press-fit to each other. This press fitting is expressed, by way of example, by the fact that the individual dielectrics $\mathbf{8}_1$, $\mathbf{8}_2$, . . . , $\mathbf{8}_n$ partially project into the individual separators $\mathbf{9}_1$, $\mathbf{9}_2$, . . . $\mathbf{9}_{n-1}$.

The first dielectric $\mathbf{8}_1$ in the first filter chamber $\mathbf{7}_1$ has a depression into which the common connection 14 projects. As a result, it is in contact with the first dielectric $\mathbf{8}_1$. The same is true for the nth dielectric $\mathbf{8}_n$ in the nth filter chamber $\mathbf{7}_n$ as regards the m signal line connections $\mathbf{15}_1$, . . . , $\mathbf{15}_m$.

The multiplex filter 1 in FIG. 6A has five filter chambers $\mathbf{7}_1$, $\mathbf{7}_2$, $\mathbf{7}_3$, $\mathbf{7}_4$, . . . , $\mathbf{7}_n$, each of which has m resonator chambers $\mathbf{6}_{1_1}$, . . . , $\mathbf{6}_{1_m}$, to $\mathbf{6}_{n_1}$, . . . , $\mathbf{6}_{n_m}$. Each resonator chamber $\mathbf{6}_{1_1}$, . . . , $\mathbf{6}_{1_m}$, to $\mathbf{6}_{n_1}$, . . . , $\mathbf{6}_{n_m}$ is separated—that is, decoupled—from the other resonator chamber $\mathbf{6}_{1_1}$, . . . , $\mathbf{6}_{1_m}$, to $\mathbf{6}_{n_1}$, . . . , $\mathbf{6}_{n_m}$ by a separator $\mathbf{9}_1$, $\mathbf{9}_2$, $\mathbf{9}_3$, . . . , $\mathbf{9}_{n-1}$. Each filter chamber $\mathbf{7}_1$, $\mathbf{7}_2$, $\mathbf{7}_3$, $\mathbf{7}_4$, . . . , $\mathbf{7}_n$ has one dielectric $\mathbf{8}_1$, $\mathbf{8}_2$, $\mathbf{8}_3$, $\mathbf{8}_4$, . . . , $\mathbf{8}_n$.

In the embodiment in FIG. 6A, the individual dielectrics $\mathbf{8}_1$, $\mathbf{8}_2$, . . . , $\mathbf{8}_n$ entirely fill in the volumes of the respective filter chambers $\mathbf{7}_1$, $\mathbf{7}_2$, . . . , $\mathbf{7}_n$. The dielectrics $\mathbf{8}_1$, $\mathbf{8}_2$, . . . , $\mathbf{8}_n$ in this embodiment have the same dimensions with respect to their heights, but differ from each other as concerns their respective diameters. They could also have the same diameter. In this case, the inserts $\mathbf{11}_1$, $\mathbf{11}_2$, $\mathbf{11}_3$, $\mathbf{11}_4$, . . . , $\mathbf{11}_n$ would all have the same inner diameter. In FIG. 6A, the outer diameter is the same for all of the inserts $\mathbf{11}_1$, $\mathbf{11}_2$, $\mathbf{11}_3$, $\mathbf{11}_4$, . . . , $\mathbf{11}_n$, but the wall thickness—that is, the inner diameter—is different. This means that the volumes of the individual filter chambers $\mathbf{7}_1$, $\mathbf{7}_2$, . . . , $\mathbf{7}_n$ are different. The outer surfaces of the inserts $\mathbf{11}_1$, $\mathbf{11}_2$, . . . , $\mathbf{11}_n$—that is, the peripheral wall—is in contact with an inner surface of the housing wall 5. The electrically conductive housing cover 4 is in electrical contact with both an end face of the housing 5 and an end face of the first insert $\mathbf{11}_1$. The housing base 3 is likewise in electrical contact with the housing 5 and an end face of the nth insert $\mathbf{11}_n$.

It is hereby noted that the housing 5 can be electrically conductive—that is, can be made of metal, for example—but need not be. In other words, the housing 5 can consist of any other arbitrary material—particularly a non-conductive material such as a dielectric or plastic. The function of the housing 5 is to hold the components situated in the interior of the housing 5 together mechanically, and fix the same mechanically in place. In any case, the housing 5 can only consist of a dielectric if it is ensured that the filter chambers $\mathbf{7}_1$, $\mathbf{7}_2$, . . . , $\mathbf{7}_n$ are shielded from the surroundings of the multiplex filter 1. Such a shielding can be realized, by way of example, by the inserts $\mathbf{11}_1$, $\mathbf{11}_2$, . . . , $\mathbf{11}_n$.

The separators $\mathbf{9}_1$, $\mathbf{9}_2$, . . . $\mathbf{9}_{n-1}$ have an outer diameter which preferably corresponds to an inner diameter of the housing wall 5. This means that an outer surface—that is, a peripheral wall of each separator $\mathbf{9}_1$, $\mathbf{9}_2$, . . . $\mathbf{9}_{n-1}$—contacts the inner surface of the housing—that is, has a mechanical contact with the same. The coupling openings 10 of a separator $\mathbf{9}_1$, $\mathbf{9}_2$, . . . $\mathbf{9}_{n-1}$ can differ from the coupling openings of the other separator $\mathbf{9}_1$, $\mathbf{9}_2$, . . . $\mathbf{9}_{n-1}$ with respect to their arrangement—that is, their orientation and/or their number and/or their size and/or their cross-section shape. The coupling openings 10 of a separator $\mathbf{9}_1$, $\mathbf{9}_2$, . . . $\mathbf{9}_{n-1}$ can even be different with respect to their arrangement—that is, their orientation and/or their number and/or their size and/or their cross-section shape.

In the embodiment in FIG. 6A, the coupling openings 10 of the individual separators $\mathbf{9}_1$, $\mathbf{9}_2$, . . . , $\mathbf{9}_{n-1}$ have a different diameter, and are arranged by way of example at different points on the separators $\mathbf{9}_1$, $\mathbf{9}_2$, . . . , $\mathbf{9}_{n-1}$. The number of the coupling openings 10 can also differ. The coupling openings 10 connect the individual resonator chambers $\mathbf{6}_{1_1}$, $\mathbf{6}_{1_2}$, . . . , $\mathbf{6}_{1_m}$, to $\mathbf{6}_{n_1}$, $\mathbf{6}_{n_2}$, . . . , $\mathbf{6}_{n_m}$ of the individual filter chambers $\mathbf{7}_1$, $\mathbf{7}_2$, . . . , $\mathbf{7}_n$ to each other, and they are surrounded by the dielectric $\mathbf{8}_1$, $\mathbf{8}_2$, . . . , $\mathbf{8}_n$ of the adjacent filter chamber $\mathbf{7}_1$, $\mathbf{7}_2$, . . . , $\mathbf{7}_n$. An electrically conductive insert $\mathbf{11}_1$, $\mathbf{11}_2$, . . . , $\mathbf{11}_n$ cannot cover a coupling opening 10. It is also possible that the cross-section shape of the individual coupling openings 10 varies over the length—that is, over the height. There is typically no hollow space between the individual separators $9_1, 9_2, \ldots 9_{n-1}$ and the inserts $11_1, 11_2, \ldots, 11_n$. The same is preferably true for the first insert $11_1$ and the housing cover 4, as well as for the nth insert $11_n$ and the housing base 3.

There is likewise typically no hollow space between the inserts $11_1, 11_2, \ldots, 11_n$ along with the separator $9_1, 9_2, \ldots 9_{n-1}$ and the housing wall 5.

The dielectrics $8_1, 8_2, \ldots, 8_n$ are likewise in contact with their respective separator $9_1, 9_2, \ldots 9_{n-1}$. The dielectrics $8_1, 8_2, \ldots, 8_n$ in this case can be press-fitted and/or soldered to the respective separators $9_1, 9_2, \ldots 9_{n-1}$.

The inserts $11_1, 11_2, \ldots, 11_n$ are also preferably press-fitted and/or soldered to the corresponding separators $9_1, 9_2, \ldots 9_{n-1}$ with a positive fit. This also prevents the individual elements from rotating with respect to each other, so that the electrical properties of the high-frequency filter 1 remain unchanged over a longer period of time.

The dividing devices $13_1, \ldots, 13_n$ are likewise illustrated. The same divide the filter chambers $7_1, 7_2, \ldots, 7_n$ into the m resonator chambers $6_{1_1}, \ldots, 6_{1_m}$, to $6_{n_1}, \ldots, 6_n$ over the entire thickness of the dielectrics $8_1, \ldots, 8_n$. The first dividing device is illustrated with a dashed line because the opening region 30 for the shared coupling with the common connection 14 is also indicated in the same.

Figure 6B:
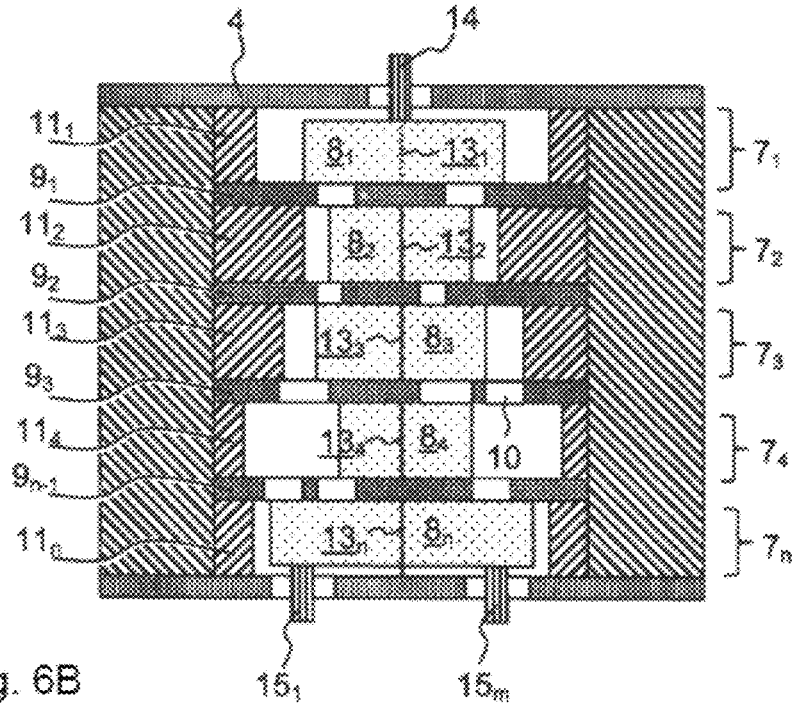
FIG. 6B: shows a longitudinal cross-section of a further embodiment of the multiplex filter, wherein some of the separators have different numbers of coupling openings, and the dielectrics do not completely fill in the filter chambers.

FIG. 6B shows a longitudinal cross-section of a further embodiment of the multiplex filter 1. The first dielectric $8_1$ is arranged with its end face spaced apart from the housing cover 4.

The common connection 14 contacts the end face of the first dielectric $8_1$. The common connection therefore is in contact with the first dielectric $8_1$. The further m signal line connections $15_1, \ldots, 15_m$ likewise contact an end face of the nth dielectric $8_n$ and are in contact with the same. The end face of the nth dielectric $8_n$ is likewise spaced apart from the housing base 3 and does not touch the same. As such, it is not in contact with the same.

In the embodiment in FIG. 6B, the individual dielectrics $8_1, 8_2, \ldots, 8_n$ do not entirely fill in the volumes of the respective filter chambers $7_1, 7_2, \ldots, 7_n$.

The coupling openings 10 connect the individual resonator chambers $6_{1_1}, \ldots, 6_{1_m}$, to $6_{n_1}, \ldots, 6_{n_m}$ of the individual filter chambers $7_1, 7_2, \ldots, 7_n$ to each other, and they are surrounded either by the open volume of one of the resonators $6_1, 6_2, \ldots, 6_n$ or by the dielectric $8_1, 8_2, \ldots, 8_n$ of the resonator $6_1, 6_2, \ldots, 6_n$.

Figure 7A:
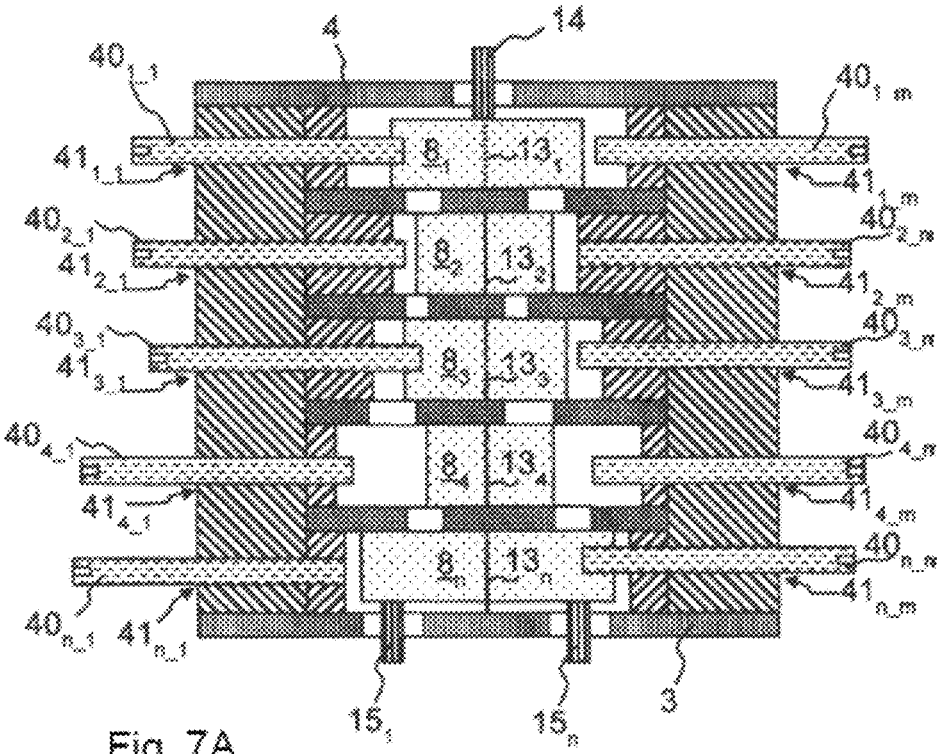
FIG. 7A: shows a longitudinal cross-section of a further embodiment of the multiplex filter, wherein tuning elements are inserted into the individual filter chambers to different depths.

FIG. 7A shows a longitudinal cross-section of a further embodiment of the multiplex filter 1, wherein tuning elements $40_{1_1}, \ldots, 40_{1_m}$, to $40_{n_1} \ldots, 40_{n_m}$ are inserted into the individual filter chambers $7_1, 7_2, \ldots, 7_n$, and therefore into the individual resonator chambers $6_{1_1}, \ldots, 6_{1_m}$, to $6_{n_m}, \ldots, 6_{n_m}$, to different depths.

At least one tuning element $40_{1_1}, \ldots, 40_{1_m}$, to $40_{n_1} \ldots, 40_{n_m}$ is inserted through an additional opening $41_{1_1}, \ldots, 41_{1_m}$, to $41_{n_1} \ldots, 41_{n_m}$ into each of the at least one filter chambers $7_1, 7_2, \ldots, 7_n$. Preferably, multiple tuning elements $40_{1_1}, \ldots, 40_{1_m}$, to $40_{n_1} \ldots 40_{n_m}$ are inserted into the filter chamber $7_1, 7_2, \ldots, 7_n$ such that preferably at least one tuning element $40_{1_1}, \ldots, 40_{1_m}$, to $40_{n_1} \ldots 40_{n_1}$ s arranged in each resonator chamber $6_{1_1}, \ldots, 6_{1_m}$, to $6_{n_1}, \ldots, 6_{n_m}$. The openings $41_{1_1}, \ldots, 41_{1_m}$, to $41_{n_1} \ldots, 41_{n_m}$ extend through the housing wall 5 and through the corresponding insert $11_1, 11_2, \ldots, 11_n$ into the filter chamber $7_1, 7_2, \ldots, 7_n$. The corresponding tuning elements $40_{1_1}, \ldots, 40_{1_m}$, to $40_{n_1} \ldots, 40_{n_m}$ can then be rotated into or out of the respective filter chamber $7_1, 7_2, \ldots, 7_n$. The distance between the tuning element $41_{1_1}, \ldots, 41_{1_m}$, to $41_{n_1} \ldots, 41_{n_m}$ and the respective dielectric $8_1, 8_2, \ldots, 8_n$ can be changed. The respective opening $40_{1_1}, \ldots, 40_{1_m}$, to $40_{n_1} \ldots, 40_{n_m}$ preferably runs perpendicular to the signal transmission direction $21_1, \ldots 21_m$, and therefore likewise perpendicular to the central axis 12.

The distance from the at least one tuning element $40_{1_1}, \ldots, 40_{1_m}$, to $40_{n_1} \ldots, 40_{n_m}$ to the respective dielectric $8_1, 8_2, \ldots, 8_n$ in the filter chamber $7_1, 7_2, \ldots, 7_n$ can be reduced to such an extent that it touches the dielectric $8_1, 8_2, \ldots, 8_n$—that is, is in contact with the same.

The nth dielectric $8_n$ in the nth filter chamber $7_n$ also has an indentation such that the nth tuning element $40_{n-1}, \ldots, 40_{n-m}$ can dip into the nth dielectric $8_n$.

Figure 7B:
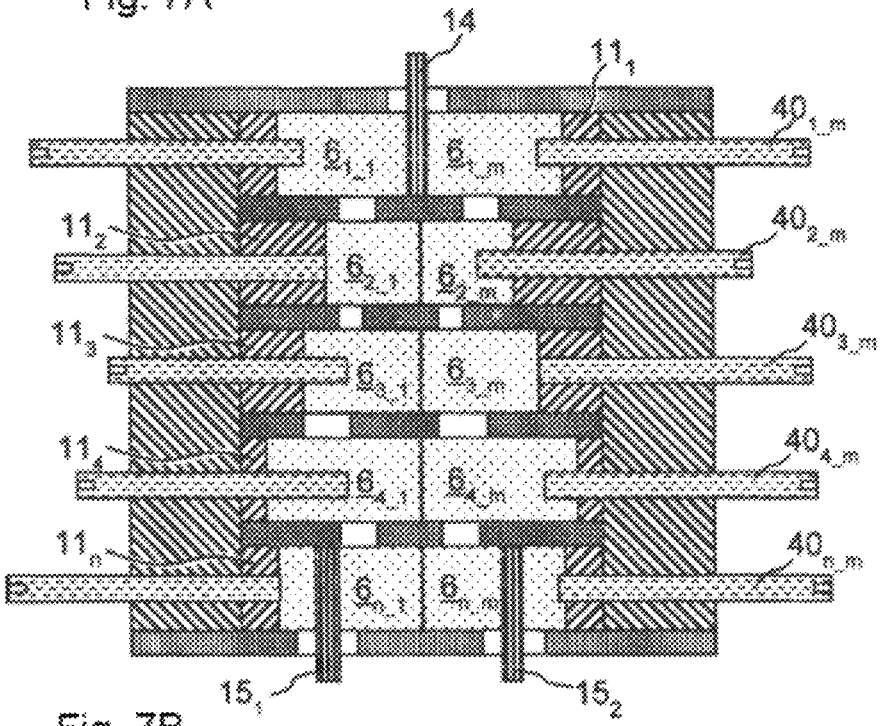
FIG. 7B: shows a longitudinal cross-section of a further embodiment of the multiplex filter, wherein tuning elements are inserted into the individual dielectrics to different depths, and the dielectrics completely fill in the respective filter chambers.

FIG. 7B shows a longitudinal cross-section of a further embodiment of the multiplex filter 1. The dielectric $8_1$ in the first filter chamber $7_1$ has a recesses which passes through the same, wherein the common connection 14 extends through said recess. The common connection 14 in this case comes into direct contact with the first separator $9_1$. The same is also true for at least one or all of the m signal line connections $15_1, \ldots, 15_m$ which extend through one or m recesses in the nth dielectric $8_n$ of the nth filter chamber $7_n$, and are in contact with the n−1th separator $9_{n-1}$.

The part of the common connection 14 or the m signal line connections $15_1, \ldots, 15_m$ which is in contact with the respective dielectric $8_1, 8_n$ or with the respective separator $9_1, 9_{n-1}$ runs parallel to the central axis 12 and/or parallel to the signal transmission direction $21_1, \ldots, 21_m$. The other parts of the common connection 14 or the m signal line connections $15_1, \ldots, 15_m$ need not necessarily run parallel to the signal transmission direction $21_1, \ldots 21_m$ and/or the central axis 12. The parts of the common connection 14 or the m signal line connections $15_1, \ldots, 15_m$ which are situated inside the first or nth filter chamber $7_1, 7_n$ are preferably those which run parallel to the signal transmission direction $21_1, \ldots 21_m$.

Figure 8:
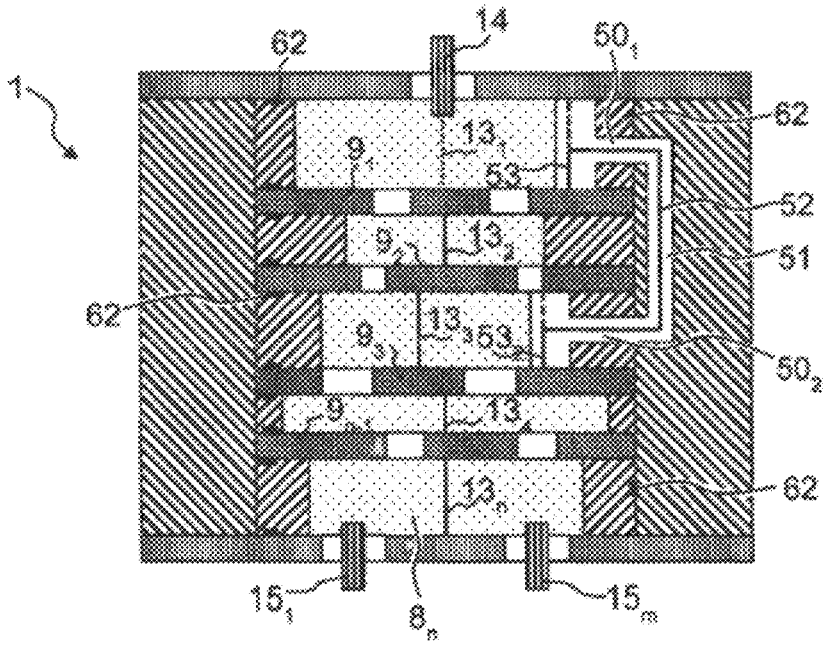
FIG. 8: shows a longitudinal cross-section of a further embodiment of the multiplex filter, wherein there is an overcoupling between the two resonator chambers which are arranged in filter chambers which are not adjacent, and additional anti-turning elements are arranged in the housing.

FIG. 8 shows a longitudinal cross-section of a further embodiment of the multiplex filter 1, wherein there is an overcoupling between the two resonator chambers $6_{1_1}, \ldots, 6_{1_m}$, to $6_{n_1}, \ldots, 6_{n_m}$ which are arranged in filter chambers $7_1, 7_2, \ldots, 7_n$ which are not adjacent to each other, wherein additional anti-turning elements 62 are arranged in the housing.

The inserts $11_1, 11_2, \ldots, 11_n$ of at least two resonator chambers $6_{1_1}, \ldots, 6_{1_m}$, to $6_{n_m}, \ldots, 6_{n_m}$ which are not directly adjacent each have one opening $50_1, 50_2$. The at least two openings $50_1, 50_2$ are connected to each other by a channel 51, and this channel 51 preferably runs parallel to the signal transmission direction $21_1, \ldots 21_m$—that is, parallel to the central axis 12. This channel 51 runs at least partially inside the housing wall 5. It is also possible for the parallel routing of this channel 51 to be entirely inside the housing wall 5. It is also possible that this channel 51 does not run entirely inside the housing wall 5, but rather solely through the inserts $11_1, 11_2, \ldots, 11_n$ and the separators $9_1, 9_2, \ldots 9_{n-1}$ which are situated between the same.

An electrical line 52 runs inside this channel 51, and the electrical line 52 couples the at least two resonator chambers $6_{1_m}, 6_{3_m}$ to each other capacitively and/or inductively. The at least two resonator chambers $6_{1_m}, 6_{3_m}$ are part of a signal transmission path even without the overcoupling. A first end $53_1$ of the electrical conductor 52 is connected to the first separator $9_1$. The first end $53_1$ of the electrical conductor 52 in this case preferably runs parallel to the signal propagation direction $21_1, \ldots 21_m$, and therefore parallel to the central axis 12. A second end $53_2$ of the electrical conductor 52 is galvanically connected to the third separator 93. The second end $53_2$ likewise preferably runs parallel to the signal propagation direction $21_1, \ldots 21_m$, and therefore parallel to the central axis 12. The first and the second end $53_1$, $53_2$ can be connected to the respective separator $9_1, 9_2, \ldots 9_{n-1}$, for example by means of a soldered connection. An overcoupling between two resonators inside the resonator chambers $6_{1_1}, \ldots, 6_{1_m}$, to $6_{n_1}, \ldots, 6_{n_1}$ s achieved by the electrical conductor 52, such that as a result it is possible to achieve a steeper filter flank of the multiplex filter 1.

The electrical conductor 52 which runs inside the channel 51 is electrically insulated and held in its position in the same preferably by dielectric spacer elements, which are not illustrated, of the walls which enclose the channel 51.

However, a first end $53_1$ of the electrical conductor 52 can also be connected to the housing cover 4, as shown by a dashed line.

A second end $53_2$ of the electrical conductor 52 can also be connected to the second separator $9_2$, as shown by a dashed line.

The first dielectric $8_1$ and the third dielectric $8_3$, wherein an overcoupling should take place between the resonator chambers $6_{1_m}$, $6_{3_m}$ thereof, preferably have a slot 80 passing through the same longitudinally. This slot 80 can be made in the ceramic dielectric $8_1, 8_2, \ldots, 8_n$ by means of a diamond saw, for example. At least the first end $53_1$ and the second end $53_2$ of the electrical conductor 52 are arranged inside this slot 80.

So that the filter properties do not change during operation, the elements arranged inside the multiplex filter 1 are secured from rotating. This is performed by multiple anti-turning elements 62 which prevent rotation. The anti-turning elements 62 can be a combination of a projection and a receptacle opening. By way of example, the housing cover 4 can have a projection which engages in a corresponding receptacle opening inside the first insert $11_1$. The anti-turning elements 62 are preferably attached between at least one of the n−1 separators $9_1, 9_2, \ldots 9_{n-1}$ and the at least one insert $11_1$ and/or the adjacent dielectric $8_1, 8_2, \ldots, 8_n$. However, preferably one anti-turning element 62 is attached in each case between the housing base 3 and/or the housing cover 4 and/or the housing wall 5 and the insert $11_1$ in the first filter chamber $7_1$ and the insert $11_n$ in the nth filter chamber $7_n$, the same preventing the elements which are arranged next to the common connection 14 and/or the m signal line connections $15_1, \ldots, 15_m$ from turning with respect to each other. This also prevents the elements which are arranged further inside the multiplex filter 1 from rotating.

The multiplex filter 1 is preferably realized with a stacked construction in which all filter chambers $7_1, 7_2, \ldots, 7_n$ are arranged one above the other. The anti-turning elements 62 in this case prevent change in the electrical properties of the individual resonator chambers $6_{1_1}, \ldots, 6_{1_m}$, to $6_{n_m}, \ldots, 6_{n_m}$ inside the filter chambers $7_1, 7_2, \ldots, 7_n$, including, for example, the resonance frequencies.

Figure 9:
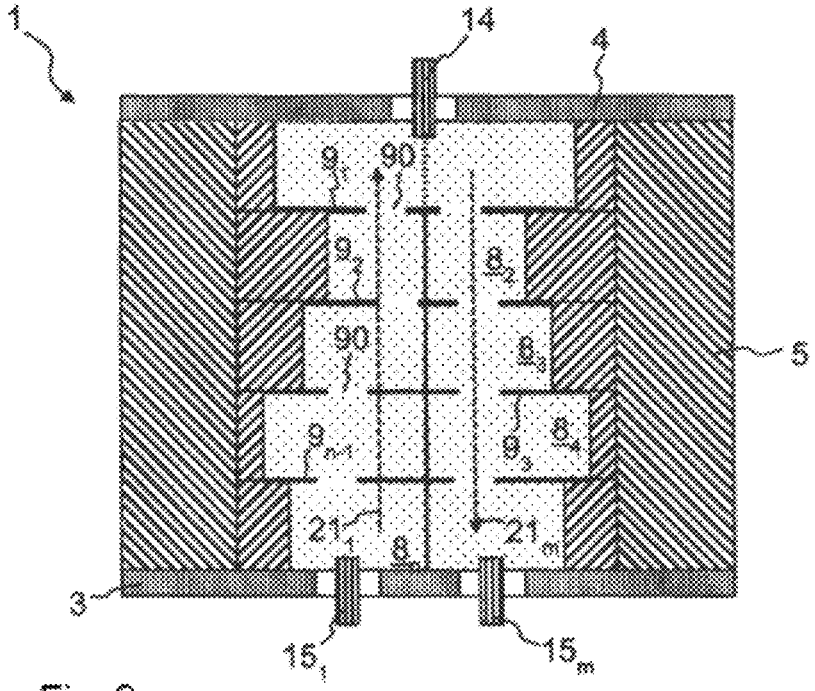
FIG. 9: shows a longitudinal cross-section of a further embodiment of the multiplex filter, wherein the dielectrics have an electrically conductive coating on their end faces and function as separators.

FIG. 9 shows a longitudinal cross-section of a further embodiment of the multiplex filter 1. The separator $9_1$, $9_2, \ldots 9_{n-1}$ in this case is an integral component of each dielectric $8_1, 8_2, \ldots, 8_n$. This means that one or both end faces of each of the n dielectrics $8_1, 8_2, \ldots, 8_n$ is coated with a metal layer. This metal layer then constitutes one of the n−1 separators $9_1, 9_2, \ldots 9_{n-1}$. A recess 90 inside the metal layer—that is, inside the coating—is then a coupling opening 10 between two resonator chambers $6_{1_1}, \ldots, 6_{1_m}$, to $6_{n_1}, \ldots, 6_{n_m}$. Adjacent dielectrics $8_1, 8_2, \ldots, 8_n$ each have the recesses 90 inside the coating of the metal layer at the same positions, to thereby enable a coupling in the signal propagation direction $21_1, \ldots 21_m$.

Figure 10:
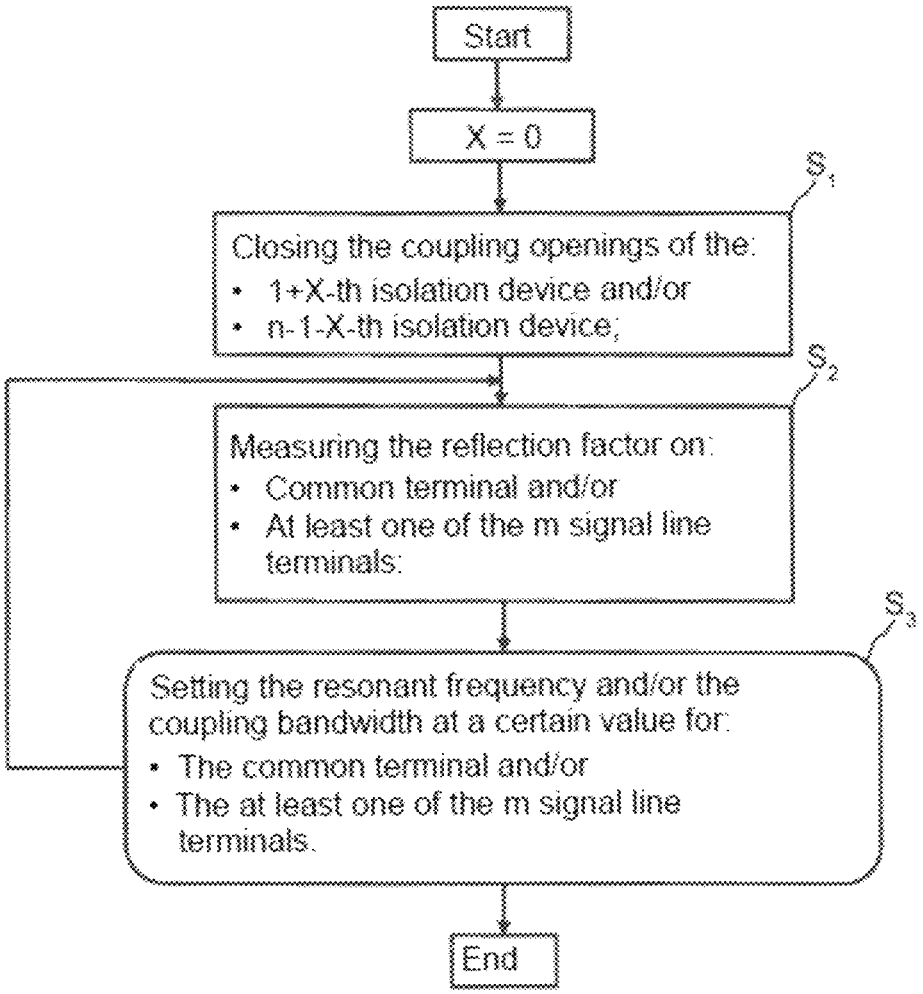
FIG. 10: shows a flow chart which explains how the resonance frequency and/or the coupling bandwidth of at least one resonator in a resonator chamber of a filter chamber is/are adjusted in order to tune the multiplex filter.

FIG. 10 shows a flow chart which explains how the resonance frequency and/or the coupling bandwidth of at least one or all of the resonators in the resonator chambers $6_{1_1}, \ldots, 6_{1_m}$, to $6_{n_1}, \ldots, 6_{n_m}$ of the first and the nth filter chambers $7_1$, $7_n$ are adjusted in order to tune the multiplex filter 1. At the start, a counter variable X is defined as 0. Then the method step $S_1$ is carried out. In method step $S_1$, all coupling openings 10 of the 1+Xth separator and/or the n−1 separator are closed. In the longitudinal cross-section shown in FIG. 6A, this would be the coupling openings 10 in the first separator $9_1$ and in the last separator $9_{n-1}$.

Then the method step $S_2$ is carried out. In method step $S_2$, the reflection factor is measured on the common connection 14 and/or on at least one, and preferably on all, signal line connections $15_1, \ldots, 15_m$. The measured reflection factor is determined solely from the geometric properties of the first and the nth resonator $6_1$, $6_n$.

Then the method step $S_3$ is carried out. In method step $S_3$, the resonance frequency and/or the coupling bandwidth of at least one, and preferably all, of the resonators in the resonator chambers $6_{1_1}, \ldots, 6_{1_m}$, to $6_{n_1}, \ldots, 6_{n_m}$ of the first and the nth filter stages $7_1$, $7_n$ are adjusted to a certain value. In alternation with the above, the method step $S_2$ is carried out in order to measure the modified reflection factor again, to then determine whether method step $S_3$ must be carried out again, or whether the adjusted values for the resonance frequency and/or the coupling bandwidth already correspond to the desired values.

The tuning of the multiplex filter 1 is performed from the outside in—that is, starting with the resonators which are directly coupled to the common connection or to the m signal line connections $15_1, \ldots, 15_m$, i.e. the resonators in the resonator chambers $6_{1_1}, \ldots, 6_{1_m}$ and $6_{n_1}, \ldots, 6_{n_m}$ which are arranged on the common connection or on the m signal line connections $15_1, \ldots, 15_m$. Further resonators or resonator chambers $6_{2_1}, \ldots, 6_{2_m}$, to $6_{n-1_1}, \ldots, 6_{n-1_m}$ of the filter chambers $7_1, 7_2, \ldots, 7_n$ are successively connected one after the other by opening the respective coupling openings. This process is described in FIG. 11, by way of example.

Figure 11:
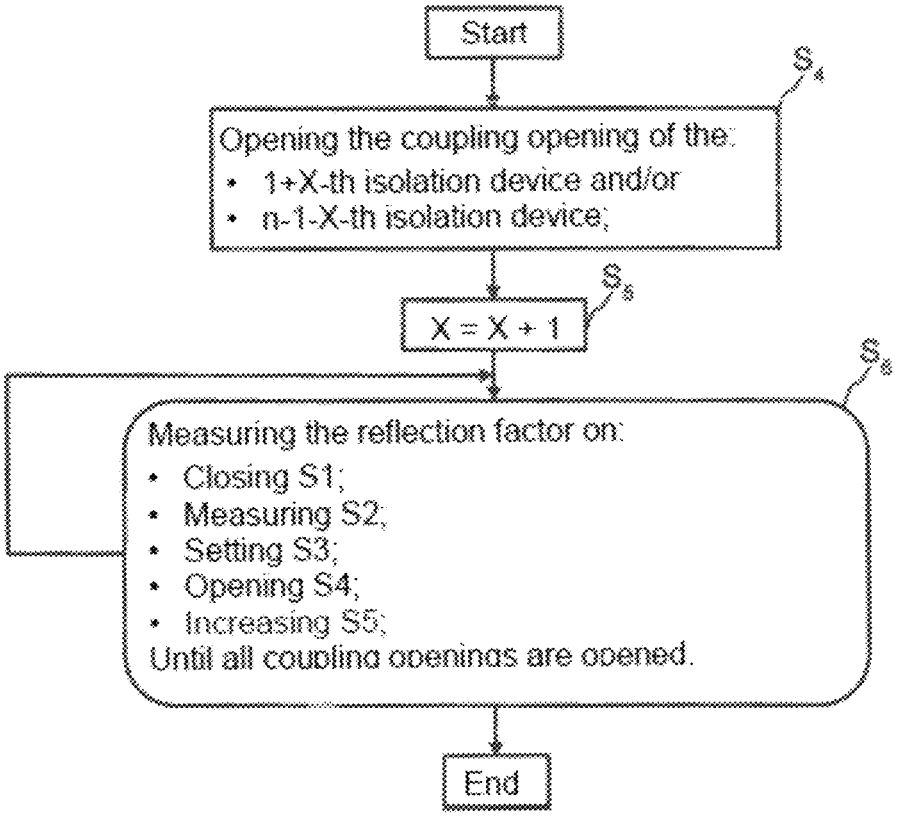
FIG. 11: shows a further flow chart which explains how the resonance frequencies and/or the coupling bandwidths is/are adjusted for the further resonators in the other filter chambers in order to tune the multiplex filter.

FIG. 11 shows a further flow chart which explains how the resonance frequencies and/or the coupling bandwidths are adjusted for the further resonators of the resonator chambers $6_{2_1}, \ldots, 6_{2_m}$, to $6_{n-1_1}, \ldots, 6_{n-1_m}$ in order to tune the multiplex filter. In the event that the resonance frequencies and/or the coupling bandwidths have been adjusted for the first resonators in the resonator chambers $6_1$, $6_n$ of the first and/or nth filter chambers $7_1$, $7_n$, the method step $S_4$ is carried out. In method step $S_4$, at least one coupling opening 10 is opened for each resonator chamber $6_{1_1}, \ldots, 6_{1_m}$ and $6_{n_1}, \ldots, 6_{n_m}$ of the 1+Xth separator and/or the n−1−Xth separator. In the longitudinal cross-section shown in FIG. 6A, this would be the coupling openings 10 in the separators $9_1$ and $9_{n-1}$.

Subsequently, the method step $S_5$ is carried out. In method step $S_5$, the value of X is increased by 1. Then the method step $S_6$ is carried out, in which the method steps $S_1$ $S_2$, $S_3$, $S_4$, $S_5$ are carried out again, in particular until all coupling openings 10 are opened. This means that, subsequently, when viewing FIG. 6A, the coupling openings 10 of the separator $9_2$ and the coupling openings 10 of the separator $9_3$ are closed. The reflection factor is again measured on the common connection 14 and/or on at least one, and preferably on all m signal line connections $15_1, \ldots, 15_m$. Then, the resonance frequency and/or the coupling bandwidth of the resonators in the filter chambers $7_2$, $7_{n-1}$, and preferably additionally the resonators in the filter chambers $7_1$, $7_{n-1}$, are adjusted.

Next, the value of X is once again increased by 1—that is, the method step $S_5$ is carried out again.

In FIG. 6A it can be seen that there is an uneven number of filter chambers $7_1$, $7_2$, . . . , $7_n$. In this method, to tune the multiplex filter 1, the resonators of the resonator chambers $6_{3_1}$, . . . , $6_{3_m}$ of the central filter chamber $7_3$—that is, the resonators in the filter chamber which is arranged in the center of the multiplex filter 1—are used one time for calculating the reflection factor on the common connection 14, and one time for calculating the reflection factor on the at least one, and preferably on all, m signal line connections $15_1$, . . . , $15_m$.

Figure 12:
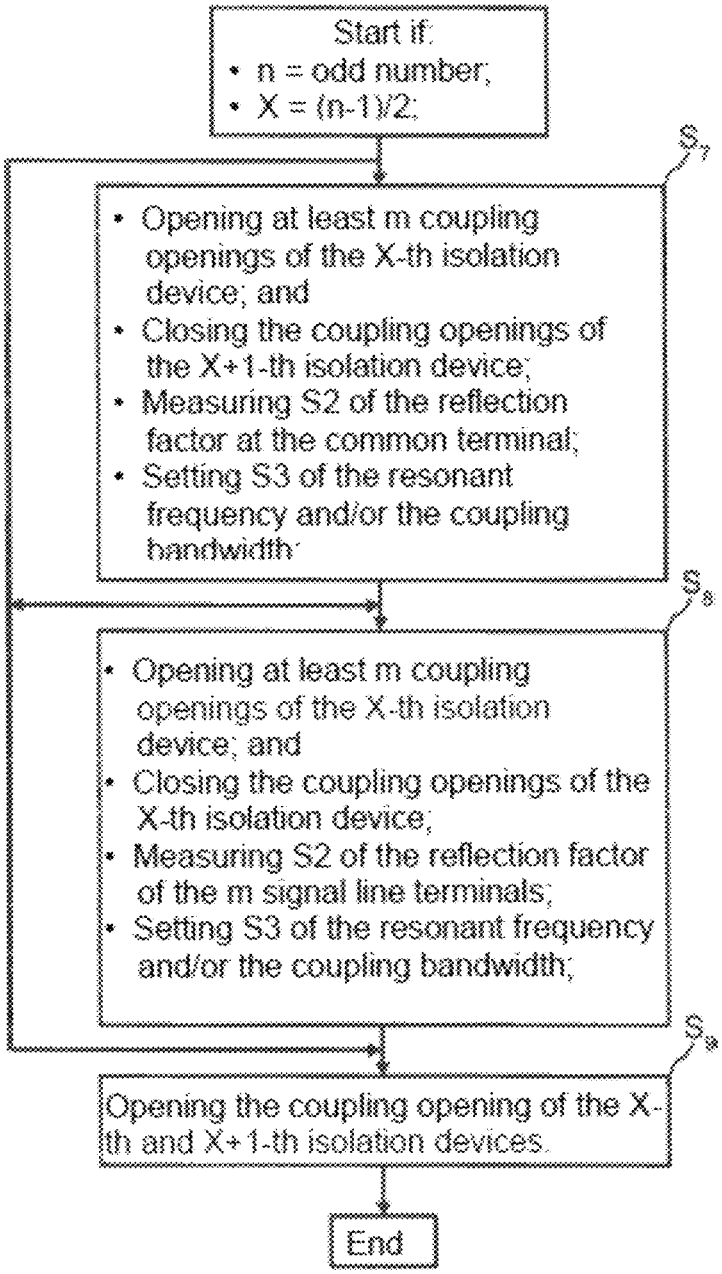
FIG. 12: shows a further flow chart which explains how the resonance frequency and/or the coupling bandwidth is/are adjusted for the resonators in the center—that is, in the central filter chambers of the multiplex filter.

This is represented in the flow chart in FIG. 12 which explains how the resonance frequencies and/or the coupling bandwidths for the resonators in the resonator chambers $6_{3_1}$, . . . , $6_{3_n}$ of the filter chamber $7_3$ in the center of the multiplex filter 1 are adjusted. In the event that X reaches the value (n−1)/2, which corresponds to the value of "2" in the embodiment in FIG. 6A, the method steps S7 and/or S8 and S9 are carried out.

In method step $S_7$, the coupling openings 10 of the Xth separator and the coupling openings 10 of the X+1th separator are closed. In the embodiment in FIG. 6A, the coupling openings 10 in the separator $9_2$ would be open, and those in the separator 93 would be closed. Next, the reflection factor is measured on the common connection 14 and the resonance frequency and/or the coupling bandwidth is accordingly adjusted.

Instead of this, or as an alternative, in the method step S8, the coupling opening 10 of the X+1th separator is opened and the coupling openings 10 of the Xth separator are closed. In the case of the embodiment in FIG. 6A, the coupling openings 10 in the separator $9_2$ would be closed, whereas the coupling openings 10 inside the separator $9_3$ would be open. Next, the method step $S_2$ is carried out again, and the reflection factor is measured on one or preferably on all m signal line connections $15_1$, . . . , $15_m$. Next, the method step $S_3$ is carried out, wherein the resonance frequency and/or the coupling bandwidth are adjusted.

The resonance frequencies and/or the coupling bandwidths of the resonators in the resonator chambers of the filter chamber in the center of the multiplex filter 1 must be adjusted in such a manner that an acceptable value is reached both for the reflection factor on the common connection 14 and for the reflection factors on one, and preferably on all, of the m signal line connections $15_1$, . . . , $15_m$. It is possible that compromises will need to be found in this case.

Next, the method step $S_9$ is carried out, and the coupling openings of the Xth and the X+1th separator are opened. In this configuration, all coupling openings 10 in all separators $9_1$, $9_2$, . . . $9_{n-1}$ are open. This configuration arises automatically after the flow chart in FIG. 11 has run through if there is an even number of filter chambers $7_1$, $7_2$, . . . , $7_n$.

Figure 13:
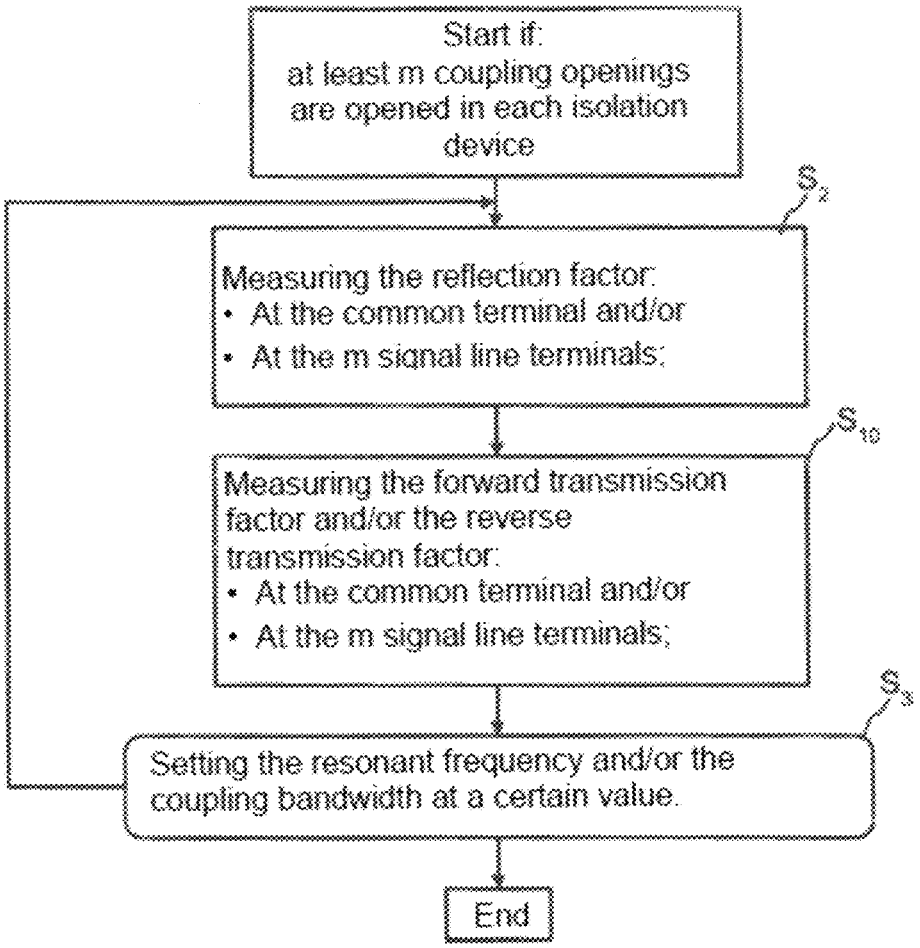
FIG. 13: shows a further flow chart which explains how the multiplex filter is tuned after at least one coupling opening is opened in each separator.

In the event that at least one, and preferably m coupling openings are open in each separator $9_1$, $9_2$, . . . $9_{n-1}$, the method steps $S_2$, $S_{10}$, and $S_3$ are carried out, as illustrated in the flow chart in FIG. 13. The method step $S_2$, which has already been explained with reference to FIG. 10, is carried out. In this method step, a reflection factor is measured on the common connection 14 and/or on at least one, and preferably on all, m signal line connections $15_m$.

Subsequently, the method step $S_{10}$ is carried out. In method step $S_{10}$, the forward transmission factor and/or the reverse transmission factor are determined.

Next, the resonance frequency and/or the coupling bandwidth are adjusted and or finely adjusted to a certain value. This occurs in the method step $S_3$. The method steps $S_2$ and $S_{10}$ can be repeated as long as the desired target value for the resonance frequency and/or the coupling bandwidth has not yet been reached in the method step $S_3$.

Figure 14:
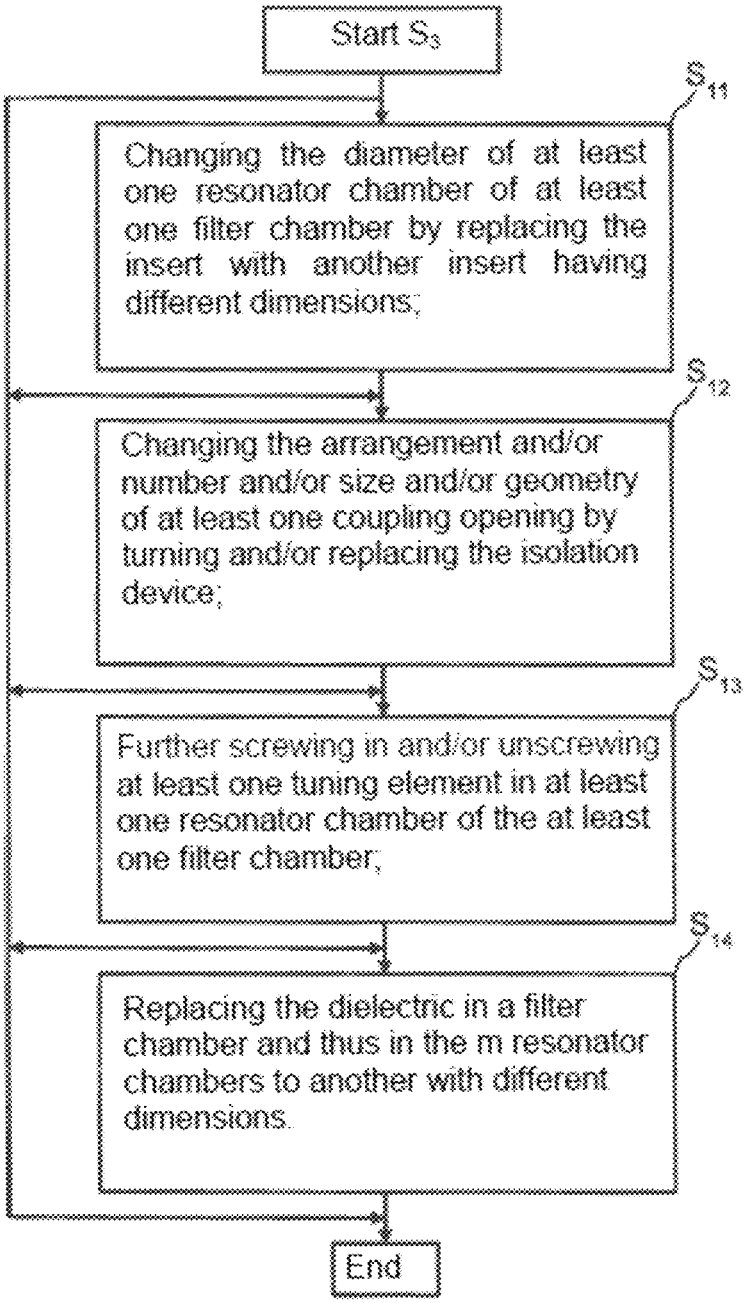
FIG. 14: shows a further flow chart which explains which measures can be used to modify the resonance frequency and/or the coupling bandwidth inside a resonator.

FIG. 14 shows a further flow chart which explains which measures can be used to modify the resonance frequency and/or the coupling bandwidth inside a resonator in a resonator chamber $6_{1_1}$, . . . , $6_{1_m}$, to $6_{n_1}$, . . . , 6 nm. The following method steps can be carried out within the method step $S_3$, individually or in combination with each other in any desired sequence. Method step $S_{11}$ describes how the resonance frequency and/or the coupling bandwidth can be adjusted by changing the diameter of the respective filter chamber $7_1$, $7_2$, . . . , $7_n$ by exchanging the insert $11_1$, $11_2$, . . . , $11_n$ for another one with different dimensions—particularly with a different inner diameter. The inserts $11_1$, $11_2$, . . . , $11_n$ in this case can also have wall segments 45 which differ from other wall segments of the same insert $11_1$, $11_2$, . . . , $11_n$ by a modified thickness, such that the resonance frequencies of the individual resonator chambers $6_{1_1}$, . . . , $6_{1_m}$, to $6_{n_1}$, . . . , $6_{n_m}$ of one filter chamber $7_1$, $7_2$, . . . , $7_n$ differ from each other.

As an alternative or in addition to the method step $S_{11}$, the method step $S_{12}$ can be carried out. In method step $S_{12}$, a separator $9_1$, $9_2$, . . . $9_{n-1}$ can be rotated such that the coupling openings 10 have another arrangement. It is also possible for the separator $9_1$, $9_2$, . . . $9_{n-1}$ to be exchanged for another, wherein the coupling openings then have another arrangement and/or another number and/or another size and/or another geometry.

Optionally, or in addition to the method steps $S_{11}$ and/or $S_{12}$, the method step $S_{13}$ can be carried out. A change of the resonance frequency and/or the coupling bandwidth can also be achieved by a further rotating of at least one tuning element $40_{1_1}$, . . . , $40_{1_m}$, to $40_{n_1}$ . . . , $40_{n_m}$ in or out of the respective resonator chamber $6_{1_1}$, . . . , $6_{1_m}$, to $6_{n_1}$, . . . , $6_{n_m}$. In addition, more than one tuning element $40_{1_1}$, . . . , $40_{1_m}$, to $40_{n_1}$ . . . , $40_{n_m}$ can be rotated into or out of a resonator chamber $6_{1_1}$, . . . , $6_{1_m}$, to $6_{n_1}$, . . . , $6_{n_m}$.

Alternatively, or in addition to the method steps $S_{11}$ $S_{12}$ and/or $S_{13}$, the method step S14 can be carried out. In method step S14, at least one dielectric $8_1$, $8_2$, . . . , $8_n$ in a filter chamber $7_1$, $7_2$, . . . , $7_n$ can be exchanged for another dielectric $8_1$, $8_2$, . . . , $8_n$ which has modified dimensions, particularly height and/or diameter.

In method step $S_1$, or each time that coupling openings 10 are to be closed, this is preferably done by exchanging the respective separator $9_1$, $9_2$, . . . $9_{n-1}$ for another which does not have any coupling openings 10.

The dividing devices $13_1$, $13_2$, . . . , $13_n$ are preferably, and fundamentally, constructed as components which are separate from the housing 2, but can nonetheless be connected to the housing 2 as a single piece.

The n dielectrics $8_1$, $8_2$, . . . , $8_n$ as well are preferably constructed as components which are separate from the housing 2. These could also be connected to the housing 2 as a single piece.

In addition, the resonator chambers $6_{1_1}$, . . . , $6_{1_m}$, to $6_{n_1}$, . . . , $6_{n_m}$ are free of any manner of inner resonator conductors which are galvanically connected by one end to the housing 2 and which extend into the resonator chambers $6_{1_1}$, . . . , $6_{1_m}$, to $6_{n_1}$, . . . , $6_{n_m}$, and end in the resonator chambers $6_{1_1}$, . . . , $6_{1_m}$, to $6_{n_1}$, . . . , $6_{n_m}$ at the other end. Such a construction would be conventional in cavity resonators.

The invention is not limited to the described embodiments. In the context of the invention, all described and/or indicated features can be freely combined with each other.

The invention claimed is:

1. A multiplex filter comprising:

a housing which has a housing base, a housing cover spaced apart from the housing base, and a circumferential housing wall between the housing base and the housing cover;

at least n filter chambers, wherein n≥2, which are surrounded by the housing and/or at least one insert which is situated in the housing, the at least n filter chambers being arranged along a central axis, which is perpendicular to an H field, or with a component essentially perpendicular to the H field;

a dividing device comprising metal disposed in each of the at least n filter chambers, dividing each filter chamber into m resonator chambers wherein m≥2, the m resonator chambers being arranged perpendicular to the central axis, the dividing devices being arranged parallel to the central axis or with a component essentially parallel to the central axis, the dividing devices disposed in each filter chamber separating the resonating chambers from each other;

at least n dielectrics, one of each of these at least n dielectrics being arranged in each filter chamber;

n−1 separator, every pair of filter chambers which are adjacent along the central axis being separated by one separator, each of the n−1 separators having at least m coupling openings via which every two resonator chambers which are adjacent in a signal transmission direction are coupled to each other;

the resonator chambers being coupled perpendicular to the H field and/or parallel to the central axis or with a component essentially perpendicular to the H field and/or parallel to the central axis;

a common connection which is guided into a first of the filter chambers via a first opening in the housing and is coupled inside the first of the filter chambers to the m resonator chambers; and m signal line connections which are coupled via m openings in the housing to in the m resonator chambers in the nth filter chamber.

2. A multiplex filter according to claim 1, wherein:

the n filter chambers are arranged in the signal transmission direction and/or along the central axis, wherein the H field extends radially about the central axis and/or about the signal transmission direction outward; and/or each of the n filter chambers is intersected centrally or off-center by the central axis.

3. A multiplex filter according to claim 1, wherein:

the signal transmission direction for each of the m signal line connections runs either from the signal line connection to the common connection or from the common connection to the signal line connection.

4. The multiplex filter according to claim 3, wherein:

the signal transmission direction runs from one or more of the m signal line connections to the common connection, wherein one resonator of one resonator chamber of a filter chamber is coupled to exactly one resonator of one resonator chamber of a filter chamber which is adjacent in the signal transmission direction; and/or the signal transmission direction runs from the common connection to one or more of the m signal line connections, wherein one resonator of one resonator chamber of a filter chamber is coupled to one or more resonators of the filter chamber which is adjacent in the signal transmission direction.

5. The multiplex filter according to claim 1, wherein:

at least one of the at least n filter chambers and/or one of the n dielectrics has a cylindrical shape.

6. The multiplex filter according to claim 1, wherein:

each of the n−1 separators consists of:

a) a separating leaf; or b) a metal layer with which one or two end faces of at least one or all of the n dielectrics is coated, wherein the at least one dielectric is constructed as a single piece with the at least one of the n−1 separators, and the coating of the metal layer has at least one recess as the coupling opening.

7. The multiplex filter according to claim 1, wherein:

the dividing device is formed by a plurality of through-connections inside the dielectric which are arranged in the filter chamber parallel to, or at least with a component parallel to, the central axis, whereby the dielectric is divided into m parts, wherein each of the m parts is situated in one of the m resonator chambers of a filter chamber; and/or the dielectric inside each filter chamber is composed of m parts which are the same size, wherein each of the m parts is situated in one of the m resonator chambers of a filter chamber, wherein a metal layer is formed between the individual m parts as a dividing device inside the respective filter chamber, and separates the individual resonator chambers inside a filter chamber from each other, wherein the metal layer is arranged parallel to, or at least with a component parallel to, the central axis.

8. The multiplex filter according to claim 7, wherein:

at least two or all of then dielectrics, or two or all of the m parts of at least one dielectric, consist of a different material; and/or at least one or all of the n dielectrics have a recess filled with air.

9. The multiplex filter according to claim 7, wherein:

the first filter chamber includes a region in which the dividing device only extends over a sub-length of a diameter through the first dielectric, thereby forming an opening region in which the common connection is coupled to all m resonators in the first filter chamber, wherein the opening region has a size or length which is less than 50% of a smallest diameter of the first filter chamber.

10. The multiplex filter according to claim 1, wherein:

the m resonator chambers of at least one of the filter chambers are the same size.

11. The multiplex filter according to claim 1, wherein:

a) a diameter of at least one of the at least n filter chambers is formed by at least one an annular insert, which is held by a housing wall which receives the insert; and/or b) at least one anti-turning element is attached between at least one of the n−1 separators and the at least one insert and/or the adjoining dielectric, and prevents the at least one of the n−1 separators and the at least one insert and/or the adjoining dielectric from turning with respect to each other; and/or c) at least one anti-turning element is attached between the housing base and/or the housing cover and/or the housing wall and the insert in the first filter chamber and the insert in the nth filter chamber, and prevents the housing base and/or the housing cover and/or the housing wall and the insert in the first filter chamber and the insert in the nth filter chamber from turning with respect to each other.

12. The multiplex filter according to claim 11, wherein:

the insert of at least one filter chamber has wall segments which are adjacent to the inner wall of the housing and which have different thicknesses such that the volumes of the individual resonator chambers of a filter chamber differ from each other.

13. The multiplex filter according to claim 11, wherein:

the inserts of at least two filter chambers which are not directly adjacent have an opening;

the at least two openings are connected to each other by a channel, wherein the channel runs at least partially inside the housing wall;

an electrical conductor runs between the two resonator chambers inside the channel, thereby capacitively and/or inductively coupling the two resonator chambers to each other.

14. The multiplex filter according to claim 1, wherein:

the at least n dielectrics have a disk shape; and/or at least two or all of the n dielectrics differ in their dimensions entirely or partially; and/or at least one, or all, of the at least n dielectrics entirely or partially fill in a volume of the filter chambers and therefore of the m resonator chambers inside the filter chamber in which the m resonator chambers are arranged.

15. The multiplex filter according to claim 1, wherein:

the dielectric in the first filter chamber is in contact with the first separator and the dielectric in the nth filter chamber is in contact with the n−1th separator; and/or the dielectrics of the remaining n−2 filter chambers are in contact with both of the separators which adjoin the respective filter chambers; and/or the dielectric in the first filter chamber is in contact with the housing cover and the dielectric in the nth filter chamber is in contact with the housing base; and/or the dielectrics of the at least n filter chambers are fixed to one or both separators which bound the respective filter chamber, by soldering or press fitting.

16. The multiplex filter according to claim 1, wherein:

an arrangement and/or a size and/or a cross-section shape of at least one coupling opening of one of the n−1 separators is entirely or partially different from an arrangement and/or a size and/or a cross-section shape of another coupling opening of the same n−1 separator or from a coupling opening of another of the n−1 separators; and/or the number of the coupling openings in the n−1 separators is entirely or partially different; and/or the number of the coupling openings in one of the n−1 separators used for coupling a resonator is different from the number of the coupling openings of the same separator used for coupling another resonator.

17. The multiplex filter according to claim 1, wherein:

the common connection has a central or off-center contact with the dielectric in the first filter chamber, and:

a) the dielectric in the first filter chamber has a depression into which the common connection projects, thereby establishing contact between the common connection and the first dielectric; or b) the dielectric in the first filter chamber has a recess passing through the first filter chamber, through which the common connection extends, thereby establishing contact between the common connection and the first dielectric and the first separator.

18. The multiplex filter according to claim 1, wherein:

the m signal line connections have a central or off-center contact with the dielectric which is arranged in the m resonator chambers of the nth filter chamber, and:

a) the dielectric in the nth filter chamber has up to m depressions into which the m signal line connections project, thereby establishing contact between the m signal line connections and the nth dielectric; and/or b) the dielectric in the nth filter chamber has up to m recesses passing through the nth filter chamber, through which the m signal line connections extend, thereby establishing contact between the m signal line connections and the nth dielectric, and also the n−1th separator.

19. The multiplex filter according to claim 1, wherein:

at least one or resonator chambers of each filter chamber have at least one additional opening which passes through the housing wall;

at least one tuning element is inserted through the at least one additional opening or into all additional openings, into at least one resonator chamber of each of the at least n filter chambers;

a distance between the at least one tuning element which is inserted through the at least one additional opening into the at least one of the m resonator chambers of each filter chamber and the respective dielectric inside the respective resonator chamber is capable of being modified.

20. The multiplex filter according to claim 19, wherein:

a distance between the at least one tuning element and the respective dielectric in the at least one of the m resonator chambers of each of the at least n filter chambers is capable of being reduced to such an extent that the at least one tuning element is in contact with the dielectric; or the dielectric in at least one of the m resonator chambers in at least one of the at least n filter chambers has an indentation, wherein the distance between the at least one tuning element and the respective dielectric in the resonator chamber of the at least one of the at least n filter chambers is capable of being reduced to such an extent that the at least one tuning element dips into the indentation of the respective dielectric and is in contact with the dielectric; and/or the at least one tuning element is oriented perpendicular to the central axis and/or perpendicular to the signal transmission direction in at least one of the m resonator chambers in at least one of the at least n filter chambers; and/or the at least one tuning element consists of a dielectric or the at least one tuning element consists of a dielectric which is entirely or partially coated with a metal layer, or the at least one tuning element consists of a metal.

21. The multiplex filter of claim 1 wherein $n \geq 3$.

22. The multiplex filter of claim 1 wherein $n \geq 4$.

23. The multiplex filter of claim 1 wherein $n \geq 5$.

24. A method for tuning a multiplex filter which is constructed according to claim 1, comprising:

closing all coupling openings of the 1+Xth separator and/or of the n−1-Xth separator, wherein X=0;

measuring a reflection factor on the common connection and/or measuring a reflection factor on at least one or of the m signal line connections;

adjusting a resonance frequency and/or a coupling bandwidth to a desired value.

25. The method for tuning a multiplex filter, according to claim 24, further comprising:

opening at least one of the coupling openings of the 1+Xth separator and/or of the n−1-Xth separator;

increasing X by one;

again carrying out the method steps of closing, measuring, adjusting, opening, and increasing until all coupling openings are opened.

26. The method for tuning a multiplex filter, according to claim 25, wherein the method step of again carrying out, if there is an odd number of filter chambers, comprises the following method step if X reaches the value (n−1)/2:

opening at least m coupling openings of the Xth separator and closing all coupling openings of the X+1th separator, and measuring an input reflection factor on the common connection and adjusting the resonance frequency and/or the coupling bandwidth to a desired value; and/or opening at least m coupling openings of the X+1th separator and closing all coupling openings of the Xth separator, and measuring an input reflection factor on the m signal line connections and adjusting the resonance frequency and/or the coupling bandwidth to a desired value; and opening at least m coupling openings of the Xth separator and the X+1th separator.

27. The method for tuning a multiplex filter, according to claim 25, wherein, when at least m coupling openings are open in each separator, the following method steps are carried out:

measuring a reflection factor on the common connection and/or measuring a reflection factor on the m signal line connections; and/or measuring a forward transmission factor and/or measuring a reverse transmission factor on the common connection and/or on the m signal line connections; and adjusting the resonance frequency and/or the coupling bandwidth to a desired value.

28. The method for tuning a multiplex filter, according to claim 27, wherein adjusting comprises:

modifying a diameter of at least one resonator chamber of a filter chamber by exchanging the at least one insert for another insert with modified dimensions; and/or modifying an arrangement and/or a number and/or a size and/or a cross-section shape of at least one coupling opening by rotating and/or exchanging at least one separator; and/or rotating the at least one tuning element further into or further out of at least one resonator chamber of a filter chamber; and/or exchanging the dielectric in a filter chamber for another dielectric having modified dimensions and/or recesses.

* * * * *